US008627965B2

(12) United States Patent
Hardy

(10) Patent No.: US 8,627,965 B2
(45) Date of Patent: Jan. 14, 2014

(54) MULTI-COMPONENT DISPLAY AND MERCHANDISE SYSTEMS

(75) Inventor: Stephen N. Hardy, Wadsworth, OH (US)

(73) Assignee: RTC Industries, Inc., Rolling Meadows, IL (US)

( * ) Notice: Subject to any disclaimer, the term of this patent is extended or adjusted under 35 U.S.C. 154(b) by 725 days.

(21) Appl. No.: 11/684,253

(22) Filed: Mar. 9, 2007

(65) Prior Publication Data

US 2007/0158281 A1 Jul. 12, 2007

Related U.S. Application Data

(63) Continuation of application No. 11/465,936, filed on Aug. 21, 2006, now Pat. No. 7,891,503, which is a continuation of application No. 11/216,493, filed on Aug. 31, 2005, now Pat. No. 7,093,546, which is a continuation of application No. 10/474,490, filed as application No. PCT/US02/15760 on May 17, 2002, now Pat. No. 6,964,235, application No. 11/684,253, which is a continuation-in-part of application No. 10/772,134, filed on Feb. 3, 2004, now Pat. No. 7,152,536.

(60) Provisional application No. 60/291,732, filed on May 17, 2001, provisional application No. 60/780,971, filed on Mar. 10, 2006.

(51) Int. Cl.
*A47F 1/04* (2006.01)

(52) U.S. Cl.
USPC ..... 211/59.3; 211/184

(58) Field of Classification Search
USPC ..... 211/59.3, 59.4, 43, 51, 184, 59.2, 175; 108/60, 61; 312/140.3, 140.4, 71, 61; 248/242, 292.14
See application file for complete search history.

(56) References Cited

U.S. PATENT DOCUMENTS 154,940 A 9/1874 Adams
355,511 A 1/1887 Danner
(Continued)

FOREIGN PATENT DOCUMENTS

BE 906083 4/1987
CH 412 251 4/1966
(Continued)

OTHER PUBLICATIONS

*RTC Industries, Inc.*, v. *Fasteners for Retail, Inc., and SuperValu, Inc.* d/b/a Cub Foods, Complaint, Document 1, Case No. 05C 6940 filed Dec. 8, 2005.

(Continued)

*Primary Examiner* — Joshua Rodden
(74) *Attorney, Agent, or Firm* — Banner & Witcoff, Ltd.

(57) ABSTRACT

A multi-component divider including a first divider component and a connection mechanism for a second divider component. The second divider component connects to the first divider component when the first divider component is connected to a base. The second divider component extends above the first divider component, thereby extending the overall height of the divider. The base and multi-component divider can be used in locations where there is limited space between shelves, such as a shelf in a freezer or refrigerated display, or in any application where a higher divider may be preferred, but cannot be installed. The base can additionally include a pusher moveable along a longitudinal direction of the base, wherein the pusher is also adjustable linearly along a direction perpendicular to the longitudinal direction of the base.

22 Claims, 15 Drawing Sheets

(56) References Cited

U.S. PATENT DOCUMENTS 632,231 A 9/1899 Blades
808,067 A 12/1905 Briggs
847,863 A 3/1907 Watts
1,156,140 A 10/1915 Hair
1,703,987 A 3/1929 Butler
1,712,080 A 5/1929 Kelly
1,714,266 A 5/1929 Johnson
1,734,031 A 11/1929 Carlson
1,786,392 A 12/1930 Kemp
1,964,597 A 6/1934 Rapellin
1,971,749 A 8/1934 Hamilton
1,991,102 A 2/1935 Kernaghan
2,057,627 A 10/1936 Ferris
2,079,754 A 5/1937 Waxgiser
2,085,479 A 6/1937 Shaffer et al.
2,110,299 A 3/1938 Hinkle
2,111,496 A 3/1938 Scriba
2,129,122 A 9/1938 Follett
2,218,444 A 10/1940 Vineyard
2,499,088 A 2/1950 Brill et al.
2,516,122 A 7/1950 Hughes
2,555,102 A 5/1951 Anderson
2,563,570 A 8/1951 Williams
2,652,154 A 9/1953 Stevens
2,670,853 A 3/1954 Schneider
2,678,045 A 5/1954 Erhard
2,738,881 A 3/1956 Michel
2,750,049 A 6/1956 Hunter
2,775,365 A 12/1956 Mestman et al.
2,893,596 A 7/1959 Gabrielsen
2,918,295 A 12/1959 Milner
2,934,212 A 4/1960 Jacobson
2,948,403 A 8/1960 Vallez
3,083,067 A 3/1963 Vos et al.
3,103,396 A 9/1963 Portnoy
3,151,576 A 10/1964 Patterson
3,161,295 A 12/1964 Chesley
3,166,195 A 1/1965 Taber
3,285,429 A 11/1966 Propst
3,308,961 A 3/1967 Chesley
3,308,964 A 3/1967 Pistone
3,348,732 A 10/1967 Schwarz
3,405,716 A 10/1968 Cafiero et al.
3,452,899 A 7/1969 Libberton
3,497,081 A 2/1970 Field
3,501,020 A 3/1970 Krikorian
D219,058 S 10/1970 Kaczur
3,550,979 A 12/1970 Protzmann
3,598,246 A 8/1971 Galli
3,652,154 A 3/1972 Gebel
3,667,826 A 6/1972 Wood et al.
3,698,568 A 10/1972 Armstrong
3,709,371 A 1/1973 Luck
3,751,129 A 8/1973 Wright et al.
3,814,490 A 6/1974 Dean et al.
3,815,519 A 6/1974 Meyer
3,830,169 A 8/1974 Madey
3,836,008 A 9/1974 Mraz
3,848,745 A 11/1974 Smith
3,868,021 A 2/1975 Heinrich
3,870,156 A 3/1975 O'Neill
4,007,841 A 2/1977 Seipel
4,042,096 A 8/1977 Smith
4,106,668 A 8/1978 Gebhardt et al.
4,269,326 A 5/1981 Delbrouck
4,300,693 A 11/1981 Spamer
4,303,162 A 12/1981 Suttles
4,314,700 A 2/1982 Dylag
4,331,243 A 5/1982 Doll
4,351,439 A 9/1982 Taylor
4,378,872 A 4/1983 Brown
4,448,653 A 5/1984 Wegmann
4,454,948 A 6/1984 Spamer
4,460,096 A 7/1984 Ricci
4,463,854 A 8/1984 MacKenzie
4,467,927 A 8/1984 Nathan
4,482,066 A 11/1984 Dykstra
4,488,653 A 12/1984 Belokin
4,504,100 A 3/1985 Chaumard
4,588,093 A 5/1986 Field
4,589,349 A 5/1986 Gebhardt et al.
4,602,560 A 7/1986 Jacky
4,615,276 A 10/1986 Garabedian
4,620,489 A 11/1986 Albano
4,629,072 A 12/1986 Loew
4,651,883 A 3/1987 Gullett et al.
4,685,574 A 8/1987 Young et al.
4,705,175 A 11/1987 Howard et al.
4,706,821 A 11/1987 Kohls et al.
4,724,968 A 2/1988 Wombacher
4,729,481 A 3/1988 Hawkinson et al.
4,730,741 A 3/1988 Jackle, III et al.
4,742,936 A 5/1988 Rein
4,762,235 A 8/1988 Howard et al.
4,762,236 A 8/1988 Jackle, III et al.
4,775,058 A 10/1988 Yatsko
4,776,472 A 10/1988 Rosen
4,790,037 A 12/1988 Phillips
4,809,856 A 3/1989 Muth
4,828,144 A 5/1989 Garrick
4,830,201 A 5/1989 Breslow
4,836,390 A 6/1989 Polvere
4,846,367 A 7/1989 Guigan et al.
4,883,169 A 11/1989 Flanagan, Jr.
4,899,668 A 2/1990 Valiulis
4,901,853 A 2/1990 Maryatt
4,901,869 A * 2/1990 Hawkinson et al. ..... 211/59.3
4,907,707 A 3/1990 Crum
4,934,645 A 6/1990 Breslow
5,012,936 A 5/1991 Crum
5,025,936 A 6/1991 Lamoureaux
5,027,957 A 7/1991 Skalski
5,082,125 A 1/1992 Ninni
5,088,607 A 2/1992 Risafi et al.
5,110,192 A 5/1992 Lauterbach
5,111,942 A 5/1992 Bemardin
5,123,546 A 6/1992 Crum
5,131,563 A 7/1992 Yablans
5,148,927 A 9/1992 Gebka
5,161,702 A 11/1992 Skalski
5,178,258 A 1/1993 Smalley
5,183,166 A 2/1993 Belokin, Jr. et al.
5,190,186 A 3/1993 Yablans et al.
5,203,463 A 4/1993 Gold
5,215,199 A 6/1993 Bejarano
5,255,802 A 10/1993 Krinke et al.
5,265,738 A 11/1993 Yablans
5,316,154 A 5/1994 Hajec, Jr.
5,341,945 A 8/1994 Gibson
5,351,839 A 10/1994 Beeler et al.
5,366,099 A 11/1994 Schmid
5,381,908 A 1/1995 Hepp
5,390,802 A 2/1995 Pappagallo et al.
5,413,229 A 5/1995 Zuberbuhler et al.
5,415,297 A 5/1995 Klein et al.
5,450,969 A 9/1995 Johnson et al.
5,458,248 A 10/1995 Alain
5,464,105 A 11/1995 Mandeltort
5,469,975 A 11/1995 Fajnsztajn
5,469,976 A 11/1995 Burchell
5,542,552 A 8/1996 Yablans et al.
5,562,217 A 10/1996 Salveson et al.
5,613,621 A 3/1997 Gervasi
D378,888 S 4/1997 Bertilsson
5,615,780 A 4/1997 Nimetz et al.
5,634,564 A 6/1997 Spamer et al.
5,638,963 A 6/1997 Finnelly et al.
5,665,304 A 9/1997 Heinen et al.
5,673,801 A 10/1997 Markson
D386,363 S 11/1997 Dardashti
5,685,664 A 11/1997 Parham et al.
5,730,320 A 3/1998 David
5,738,019 A 4/1998 Parker
5,740,944 A 4/1998 Crawford

(56) References Cited

U.S. PATENT DOCUMENTS

| | | | | |
|---|---|---|---|---|
| 5,743,428 | A | 4/1998 | Rankin, VI | |
| 5,746,328 | A | 5/1998 | Beeler et al. | |
| 5,788,090 | A | 8/1998 | Kajiwara | |
| 5,803,276 | A | 9/1998 | Vogler | |
| 5,826,731 | A | 10/1998 | Dardashti | |
| 5,839,588 | A | 11/1998 | Hawkinson | |
| 5,855,283 | A | 1/1999 | Johnson | |
| 5,873,473 | A | 2/1999 | Pater | |
| 5,878,895 | A | 3/1999 | Springs | |
| 5,906,283 | A | 5/1999 | Kump et al. | |
| 5,971,204 | A | 10/1999 | Apps | |
| 6,006,678 | A | 12/1999 | Merit | |
| 6,041,720 | A | 3/2000 | Hardy | |
| 6,082,557 | A | 7/2000 | Leahy | |
| 6,112,938 | A | 9/2000 | Apps | |
| 6,129,218 | A | 10/2000 | Henry et al. | |
| 6,142,317 | A | 11/2000 | Merl | |
| 6,164,491 | A | 12/2000 | Bustos et al. | |
| 6,173,845 | B1 | 1/2001 | Higgins et al. | |
| 6,209,733 | B1 | 4/2001 | Higgins et al. | |
| 6,227,385 | B1 | 5/2001 | Nickerson | |
| 6,234,325 | B1 | 5/2001 | Higgins et al. | |
| 6,234,326 | B1 | 5/2001 | Higgins et al. | |
| 6,234,328 | B1 | 5/2001 | Mason | |
| D445,615 | S | 7/2001 | Burke | |
| 6,253,954 | B1 | 7/2001 | Yasaka | |
| 6,357,606 | B1 | 3/2002 | Henry | |
| 6,382,431 | B1 | 5/2002 | Burke | |
| 6,389,991 | B1 | 5/2002 | Morrisson | |
| 6,401,942 | B1 | 6/2002 | Eckert | |
| 6,405,880 | B1 | 6/2002 | Webb | |
| 6,409,027 | B1 | 6/2002 | Chang et al. | |
| 6,409,028 | B2 * | 6/2002 | Nickerson | 211/59.3 |
| 6,464,089 | B1 | 10/2002 | Rankin, VI | |
| 6,484,891 | B2 | 11/2002 | Burke | |
| 6,497,326 | B1 | 12/2002 | Osawa | |
| 6,523,703 | B1 | 2/2003 | Robertson | |
| 6,527,127 | B2 | 3/2003 | Dumontet | |
| 6,533,131 | B2 | 3/2003 | Bada | |
| D472,411 | S | 4/2003 | Burke | |
| 6,598,754 | B2 * | 7/2003 | Weiler | 211/184 |
| 6,622,874 | B1 | 9/2003 | Hawkinson | |
| 6,655,536 | B2 * | 12/2003 | Jo et al. | 211/59.3 |
| 6,666,533 | B1 | 12/2003 | Stavros | |
| D485,699 | S | 1/2004 | Mueller et al. | |
| 6,769,552 | B1 | 8/2004 | Thalenfeld | |
| 6,772,888 | B2 * | 8/2004 | Burke | 211/59.3 |
| 6,820,754 | B2 | 11/2004 | Ondrasik | |
| 6,824,009 | B2 | 11/2004 | Hardy | |
| 6,866,156 | B2 | 3/2005 | Nagel et al. | |
| 6,886,699 | B2 | 5/2005 | Johnson et al. | |
| 6,889,854 | B2 | 5/2005 | Burke | |
| 6,923,330 | B1 | 8/2005 | Nagel | |
| 6,948,900 | B1 | 9/2005 | Neuman | |
| 6,964,235 | B2 | 11/2005 | Hardy | |
| 7,028,852 | B2 | 4/2006 | Johnson et al. | |
| 7,195,123 | B2 | 3/2007 | Roslof et al. | |
| 7,201,281 | B1 | 4/2007 | Welker | |
| 7,216,770 | B2 | 5/2007 | Mueller | |
| 7,395,938 | B2 * | 7/2008 | Merit et al. | 211/59.4 |
| 7,424,957 | B1 | 9/2008 | Luberto | |
| 7,458,473 | B1 | 12/2008 | Mason | |
| 7,497,342 | B2 | 3/2009 | Hardy | |
| 7,500,571 | B2 | 3/2009 | Hawkinson | |
| 7,641,057 | B2 | 1/2010 | Mueller et al. | |
| 7,681,744 | B2 | 3/2010 | Johnson | |
| 7,703,614 | B2 | 4/2010 | Schneider et al. | |
| 7,784,623 | B2 | 8/2010 | Mueller et al. | |
| 7,891,503 | B2 | 2/2011 | Hardy | |
| 8,016,139 | B2 | 9/2011 | Hanners et al. | |
| 8,113,360 | B2 | 2/2012 | Olson | |
| 8,177,076 | B2 | 5/2012 | Rataiczak, III et al. | |
| 2001/0010302 | A1 | 8/2001 | Nickerson | |
| 2002/0036178 | A1 | 3/2002 | Tombu | |
| 2002/0108916 | A1 | 8/2002 | Nickerson | |
| 2002/0148794 | A1 | 10/2002 | Marihugh | |
| 2002/0170866 | A1 | 11/2002 | Johnson et al. | |
| 2003/0000956 | A1 | 1/2003 | Maldonado | |
| 2003/0010732 | A1 * | 1/2003 | Burke | 211/59.3 |
| 2003/0029824 | A1 | 2/2003 | Weiler | |
| 2003/0057167 | A1 | 3/2003 | Johnson et al. | |
| 2003/0061973 | A1 | 4/2003 | Bustos | |
| 2003/0085187 | A1 | 5/2003 | Johnson et al. | |
| 2003/0141265 | A1 | 7/2003 | Jo et al. | |
| 2003/0217980 | A1 | 11/2003 | Johnson et al. | |
| 2004/0104239 | A1 | 6/2004 | Black, Jr. et al. | |
| 2004/0140278 | A1 | 7/2004 | Mueller et al. | |
| 2004/0140279 | A1 | 7/2004 | Mueller et al. | |
| 2004/0245197 | A1 | 12/2004 | McElvaney | |
| 2005/0166806 | A1 | 8/2005 | Hardy | |
| 2005/0218094 | A1 * | 10/2005 | Howerton et al. | 211/59.3 |
| 2005/0286700 | A1 | 12/2005 | Hardy | |
| 2006/0049122 | A1 | 3/2006 | Mueller et al. | |
| 2006/0163272 | A1 | 7/2006 | Gamble | |
| 2006/0186064 | A1 | 8/2006 | Merit et al. | |
| 2006/0186066 | A1 | 8/2006 | Johnson et al. | |
| 2006/0237381 | A1 | 10/2006 | Lockwood et al. | |
| 2007/0068885 | A1 | 3/2007 | Busto et al. | |
| 2007/0138114 | A1 | 6/2007 | Dumontet | |
| 2008/0156752 | A1 | 7/2008 | Bryson et al. | |
| 2010/0252519 | A1 | 10/2010 | Hanners et al. | |

FOREIGN PATENT DOCUMENTS

| | | | |
|---|---|---|---|
| DE | 969003 | | 4/1958 |
| DE | 1819158 | | 7/1960 |
| DE | 2002720 | | 7/1971 |
| DE | 7311113 | | 8/1973 |
| DE | 2232398 | | 1/1974 |
| DE | 28 25 724 | A1 | 12/1979 |
| DE | 8308485 | | 9/1983 |
| DE | 8426651 | | 7/1985 |
| DE | 299 02 688 | | 7/1999 |
| EP | 0004921 | | 4/1979 |
| EP | 0018003 | | 7/1984 |
| EP | 0224107 | A2 | 11/1986 |
| EP | 270016 | | 6/1988 |
| EP | 0 337 340 | | 10/1989 |
| EP | 0408400 | A1 | 7/1990 |
| EP | 0 398 500 | A1 | 11/1990 |
| EP | 0 454 586 | B1 | 10/1991 |
| EP | 0587059 | | 3/1994 |
| EP | 986980 | | 3/2000 |
| EP | 0 779 047 | B1 | 4/2000 |
| EP | 1174060 | A1 | 1/2002 |
| EP | 1510156 | A2 | 3/2003 |
| EP | 1256296 | A3 | 10/2003 |
| EP | 1395152 | | 2/2005 |
| EP | 0176209 | | 4/2008 |
| FR | 2 385 365 | | 10/1978 |
| FR | 2526338 | | 11/1983 |
| FR | 2617385 | | 1/1989 |
| GB | 697994 | | 10/1953 |
| GB | 740311 | | 11/1955 |
| GB | 881 700 | | 11/1961 |
| GB | 1082150 | | 9/1967 |
| GB | 2 027339 | A | 2/1980 |
| GB | D. 2037553 | | 7/1994 |
| GB | 2281289 | | 1/1995 |
| GB | 2 283 407 | A | 5/1995 |
| GB | 2290077 | | 12/1995 |
| GB | 2297241 | A | 7/1996 |
| GB | 1088654 | | 11/2000 |
| GB | 2392667 | A | 10/2004 |
| JP | 54168195 | | 11/1979 |
| JP | 59 218113 | | 8/1984 |
| JP | 62060521 | A | 3/1987 |
| JP | 6329463 | | 2/1988 |
| JP | 02-191413 | | 7/1990 |
| JP | 6202945 | | 7/1994 |
| JP | 11342054 | | 12/1999 |
| JP | 2000157378 | | 6/2000 |
| JP | 2000350642 | | 12/2000 |
| JP | 2001104117 | | 4/2001 |

(56) References Cited

FOREIGN PATENT DOCUMENTS

| | | | |
|---|---|---|---|
| JP | 2003210286 | | 7/2003 |
| NL | 106617 | | 11/1963 |
| NL | 8520125 | | 1/1986 |
| SE | 394537 | | 6/1977 |
| SU | 1600615 | | 10/1990 |
| WO | 91/15141 | A | 10/1991 |
| WO | 0071004 | | 11/2000 |
| WO | 02/091885 | | 11/2002 |
| WO | 03005862 | A2 | 1/2003 |
| WO | WO 03/013316 | * | 2/2003 |
| WO | 03/032775 | | 4/2003 |
| WO | 2006019947 | A2 | 2/2006 |

OTHER PUBLICATIONS

*RTC Industries, Inc*., v. *Fasteners for Retail, Inc., and SuperValu, Inc.* d/b/a Cub Foods, Answer of Defendant Fasteners for Retail, Inc., Civil Action No. O5 C 6940, Document 20, filed Jan. 18, 2006.

International Search Report for PCT/US2007/63730 dated Feb. 20, 2008.

FFR Yellow Pages® 2003 Product Catalog, "Merchandising Ideas Made Easy for Every Retail Environment!", Cover p. 9-11, 48-49, 52-58, Back Cover.

*RTC Industries, Inc*., v. *Henschel-Steinau, Inc*., Complaint, Case: 1:10-cv-07460 Document #:1 Filed Nov. 19, 2010.

*RTC Industries, Inc*., v. *Fasteners for Retail, Inc., and SuperValu, Inc.* d/b/a Cub Foods, Stipulation of Dismissal, Civil Action No. 05 C 6940, Apr. 2006.

*RTC* vs. *Fasteners for Retail*, Case No. 05C 6940, Document No. 26, filed Apr. 25, 2006.

*RTC Industries, Inc*., v. *HMG Worldwide Corporation*, Complaint, Civil Action No. 00C 3300, dated May 31, 2000.

*RTC Industries, Inc.* v. *HMG Worldwide Corporation*, Amended Complaint, dated Jan. 19, 2001.

*RTC Industries, Inc.* v. *HMG Worldwide Corporation*, RTC's Reply to HMG Worldwide Corporation's Amended Counterclaims, Civil Action No. 00 CV 3300, dated Mar. 7, 2001.

*RTC Industries, Inc.* v. *William Merit & Associates, Inc*., Memorandum Opinion, Civil Action No. 04 C 1254, dated Jul. 15, 2004.

*RTC Industries, Inc.* v. *HMG Worldwide Corporation*, Notice of Motion, Civil Action No. 00 Civ. 3300 (JHL), dated Feb. 22, 2001.

*RTC Industries, Inc.* v. *William Merit & Associates, Inc*., Evidentiary Objections to RTC Industries, Inc.'s Memorandum in Opposition to William Merit & Associates' Motion for Partial Summary Judgment, Civil Action No. 04 C 1254, dated Jul. 2, 2004.

*RTC Industries, Inc*., v. *William Merit & Associates, Inc*., William Merit & Associates' Reply to RTC Industries, Inc.'s Response to William Merit & Associates' Statement under Local Rule 56.1 of Material Facts to Which There is No Geniune Issue and Statement of Additional Facts that Require the Denial of Summary Judgement, Civil Action No. 04 C 1254, dated Jul. 2, 2004.

*RTC Industries, Inc.* v. *William Merit & Associates, Inc*., Exhibits and Declarations in Support of William Merit & Associates, Inc.'s Reply to RTC Industries, Inc.'s Memorandum in Opposition to William Merit & Associates' Motion for Partial Summary Judgment, Civil Action No. 04 C 1254, dated Jul. 2, 2004.

*RTC Industries, Inc*., v. *William Merit & Associates, Inc*., Notice of RTC Industries, Inc.'s Motion for Leave to File its Sur-Reply to William Merit's Motion for Partial Summary Judgment, Civil Action No. 04 C 1254, dated Jul. 6, 2004.

*RTC Industries, Inc*., v. *William Merit & Associates, Inc*., RTC Industries, Inc.'s Sur-Reply to William Merit's Motion for Partial Summary Judgment, Civil Action No. 04 C 1254, dated Jul. 6, 2004.

*RTC Industries, Inc.* v. *William Merit & Associates, Inc.* RTC's Response to Defendant's Evidentiary Objections to RTC Industries, Inc.'s Memorandum in Opposition to William Merit & Associates' Motion for Partial Summary Judgment, Civil Action No. 04 C 1254, dated Jul. 6, 2004.

*RTC Industries, Inc.* v. *Fasteners for Retail Inc*., Plaintiff RTC Industries Inc.'s Complaint, Civil Action No. 03C 3137, dated May 12, 2003.

*RTC Industries, Inc*., v. *Fasteners for Retail Inc*., and CVS Corporation, Amended Complaint, Civil Action No. 03C 3137, dated Aug. 6, 2003.

*RTC Industries, Inc.* v. *Semasys, Inc., and Uni-Sun, Inc*., Complaint, Civil Action No. 04C 4081, dated Jun. 17, 2004.

*RTC Industries, Inc.* v. *Display Specialties, Inc*., Complaint, Civil Action No. 04C 3370, dated May 12, 2004.

*RTC Industries, Inc.* v. *William Merit & Associates, Inc*, Complaint, Civil Action No. 04C 1254, dated Feb. 18, 2004.

*RTC Industries, Inc.* v. *William Merit & Associates, Inc*., Defendant's Notice of Motion for Partial Summary Judgment of Non-Infringement that Claims 1-8 of U.S. Patent No. 4,830,201 are Not Infringed, Civil Action No. 04C 1254, dated Apr. 29, 2004.

*RTC Industries, Inc*., v. *William Merit & Associates*, William Merit & Associates, Inc.'s Statement Under Local Rule 56.1 of Material Facts to Which There is no Genuine Issue, Civil Action No. 04 C 1254, dated Apr. 29, 2004.

*RTC Industries, Inc.* v. *William Merit & Associates, Inc*., Defendant's Notice of Motion for Leave to File Memorandum in Support of Motion for Partial Summary Judgment in Excess of Page Limit, Civil Action No. 04 C 1254, dated Apr. 29, 2004.

*RTC Industries, Inc.* v. *William Merit & Associates, Inc*., Declaration of William Merit in Support of Defendant's Motion for Partial Summary Judgment that Claims 1-8 of U.S. Patent No. 4,830,201 are Not Infringed, Civil Action No. 04 C 1254, dated Apr. 29, 2004.

*RTC Industries, Inc.* v. *William Merit & Associates, Inc*., RTC Industries, Inc.'s Responses to Defendant William Merit & Associates, Inc.'s First Set of Requests for Admission to Plaintiff RTC Industries, Inc., Civil Action No. 04 C 1254, dated Jun. 1, 2004.

*RTC Industries, Inc*., v. *William Merit & Associates, Inc*., RTC Industries, Inc.'s Memorandum in Opposition to William Merit & Associates' Motion for Partial Summary Judgment, Civil Action No. 04 C 1254, dated Jun. 18, 2004.

*RTC Industries, Inc.* v. *William Merit & Associates, Inc*., Notice of Filing of Additional Exhibit (The Chesley Patent) to RTC Industries, Inc.'s Memorandum in Opposition to William Merit & Associates' Motion for Partial Summary Judgment, Civil Action No. 04 C 1254, dated Jun. 22, 2004.

*RTC Industries, Inc.* v. *William Merit & Associates, Inc*., William Merit & Associates Inc.'s Reply to RTC Industries, Inc.'s Memorandum in Opposition to William Merit & Associates' Motion for Partial Summary Judgment, dated Jul. 2, 2004.

*RTC Industries, Inc*., v. *Fasterners for Retail, Inc. and SuperValu, Inc.* d/b/a Cub Foods, Answer of Defendant for Retail, Inc., Civil Action No. 05 C 6940, Document 20, filed Jan. 18, 2006.

*RTC Ind* v. *William Merit & Assoc*., United States District Court Northern District of Illinois (Chicago), Case #:1:04-cv-01254.

*RTC Ind*. v. *Fasteners for Retail, et al*., United States District Court Northern District of Illinois (Chicago), Case #:1:03-cv-03137.

*RTC Ind*. v. *HMG Worldwide Corp*., United States District Court Northern District of Illinois (Chicago), Case #:1:00-cv-03300.

*RTC Ind*. v. *Display Specialties*, United States District Court Northern District of Illinois (Chicago), Case #:1:04-cv-03370.

*RTC Ind*. v. *Semasys Inc., et al*. United States District Court Northern District of Illinois (Chicago), Case #:1:04-cv-04081.

*RTC Ind*. v. *Fasteners for Retail, et al*., United States District Court Northern District of Illinois (Chicago), Case #:1:05-cv-06940.

*VIDPRO International Inc.* v. *RTC Industries, Inc*., U.S. District Court Northern District of Texas (Dallas), Case #:3:95-cv-01055-G.

*RTC Industries, Inc.* v. *Fasteners for Retail Inc., and CVS Corporation*, Reply, Civil Action No. 03C 3137, dated Sep. 17, 2003.

*RTC Industries, Inc.* v. *Fasteners for Retail, Inc. and CVS Pharmacy, Inc*., to Vulcan Spring & Mfg. Co., Subpoena in a Civil Case, Case No. 03C 3137 N.D. Illinois, dated Oct. 28, 2003.

*RTC Industries, Inc.* v. *Fasteners for Retail Inc., and CVS Pharmacy, Inc*., to Rexam Beauty and Closures, Inc., Subpoena in a Civil Case, Case No. 03C 3137 N.D. Illinois, dated Nov. 11, 2003.

*RTC Industries, Inc.* v. *Fasteners for Retail Inc., and CVS Pharmacy, Inc*., to Rexam Cosmetic Packaging, Inc., Subpoena in a Civil Case, Case No. 03C 3137 N.D. Illinois, dated Nov. 11, 2003.

(56) References Cited

OTHER PUBLICATIONS

*RTC Industries, Inc*. v. *Fasteners for Retail Inc., and CVS Pharmacy, Inc*., to Rexam Cosmetic Packaging, Inc., Subpoena in a Civil Case No. 03C 3137 N.D. Illinois, dated Nov. 11, 2003.
*RTC Industries, Inc*. v. *Fasteners for Retail Inc., and CVS Corporation*, Notice of Motion to Modify and Temporarily Quash Five Subpoenas for Violation of Federal Rule of Civil Procedure 45, Civil Action No. 03C 3137, dated Dec. 18, 2003.
*RTC Industries, Inc*. v. *Fasteners for Retail, Inc. and CVS Pharmacy, Inc*., Defendants' Opposition to Plaintiff's Motion to Modify and Temporarily Quash Five Subpoenas for Violation of Federal Rule of Civil Procedure 45, Case No. 03C 3137, dated Dec. 10, 2003.
*RTC Industries, Inc*. v. *Fasteners for Retail Inc., and CVS Corporation*, RTC Industries' Reply to Defendants' Opposition to RTC's Motion to Modify and Temporarily Quash Five Subpoenas for Violation of Federal Rule of Civil Procedure 45, Civil Action No. 03C 3137, dated Dec. 11, 2003.
*RTC Ind. Inc*. v. *Fasteners for Retail*, Minute Order of Dec. 12, 2003 by Honorable Joan B. Gottschall, Case No. 1:03-cv-03137.
*RTC Industries, Inc*., v. *William Merit & Associates, Inc*., RTC Industries, Inc.'s Response to William Merit & Associates Statement under Local Rule 56.1 of Material Facts to Which There is No Genuine Issue and Statement of Additional Facts that Require the Denial of Summary Judgment, Civil Action No. 04 C 1254, dated Jun. 18, 2004.
*RTC Industries, Inc*., v. *William Merit & Associates, Inc*., Index of Exhibits, Civil Action No. 04 C 1254, dated Jun. 18, 2004.
http://www.posexpert.pl/public/files/PDF/Popychacze%20produkt%C3%B3w.pdf; Sep. 2006.
http://www.hl-display.sk/eng/Catalogue2005/Optimal-eng.pdf; 2005.
http://www.triononline.com/trionshelfworks/sw2.php; May 2007.
http://web.archive.org/web/20070516135906/http://www.triononline.com/productlines/wonderBar.php; May 2007.
http://www.lpportal.com/feature-articles/item/15-product-protection%E2%80%94beyond-eas.html; Mar. 2004.
http://www.posexpert.pl/public/files/PDF/Zarz%C4%85dzanie%20p%C3%B3%C5%82K%C4%85%20(ang.).pdf; 2006.
http://www.postuning.de/fileadmin/PDF-Downloads/Prospekte/EN_Tabak.pdf; 2006.
http://www.postuning.de/fileadmin/PDF-Downloads/Prospekte/EN_ePusher.pdf: Feb. 2005.
Vue 3040 Sanden; Apr. 2005.
http://www.storereadysolutions.com/srs.nsf/t_rinc/A56F52CF98E12B9386257449006D11DD!OpenDocument; 2006.
http://ers.rtc.com/SRSFiles/SRS_Flyer_ProfitPusher.pdf; 2006.
http://www.displaypeople.com/pdf/BOX_TO_SHELF_SELL_SHEET_Jan_19_V3.pdf.
http://www.trionline.com/pdf/ExpWTray.pdf.
http://www.ffr-dsi.com/sell-sheets/Power%20Zone%20Trak-Set%20Self-facing%20System.pdf.
Supplementary European Search Report dated May 10, 2013, for EP07758290, 5 pages.

* cited by examiner

FIG.4
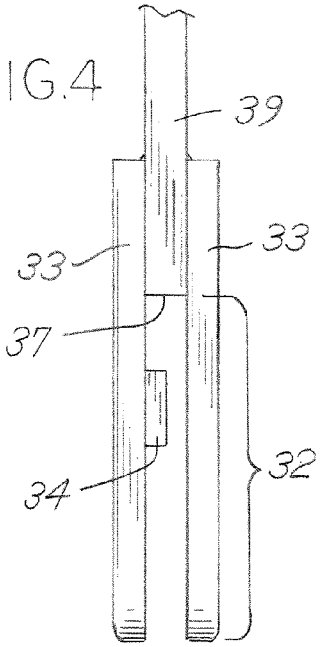
FIG.6
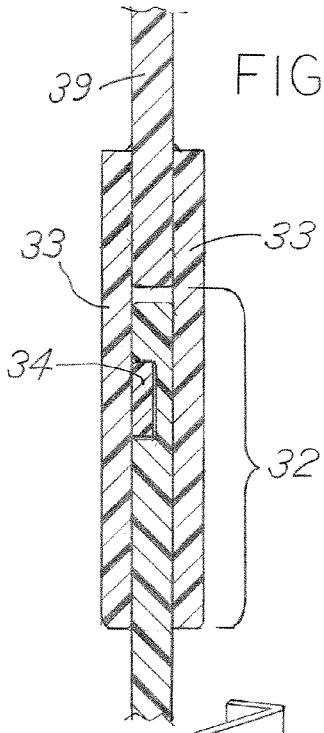
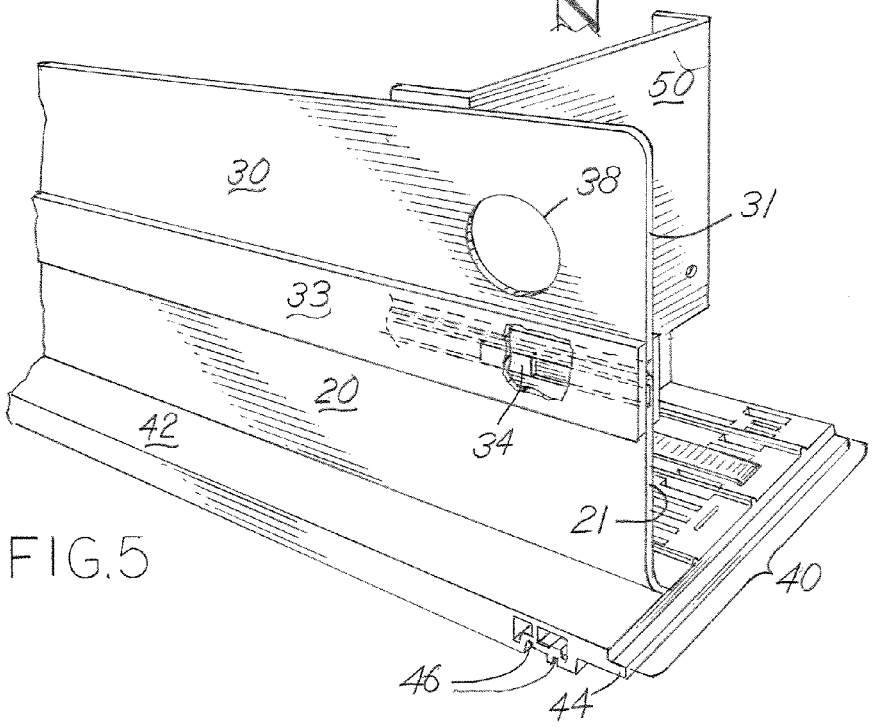
FIG.5

MULTI-COMPONENT DISPLAY AND MERCHANDISE SYSTEMS

CROSS REFERENCE TO RELATED APPLICATIONS

This application is a continuation in part of U.S. application Ser. No. 11/465,936, filed Aug. 21, 2006, which issued as U.S. Pat. No. 7,891,503, which is a continuation of U.S. application Ser. No. 11/216,493, filed Aug. 31, 2005, and issued as U.S. Pat. No. 7,093,546, which is a continuation of U.S. application Ser. No. 10/474,490 filed Oct. 8, 2003, and issued as U.S. Pat. No. 6,964,235, which claims priority to U.S. Provisional Application Ser. No. 60/291,732, filed May 17, 2001, and PCT Application Ser. No. PCT/US02/15760, filed May 17, 2002; this application also is a continuation in part of U.S. application Ser. No. 10/772,134, filed Feb. 3, 2004, which issued as U.S. Pat. No. 7,152,536; this application claims priority to U.S. provisional Application Ser. No. 60/780,971, filed Mar. 10, 2006 and each of the applications mentioned above.

U.S. Pat. No. 6,964,235 and U.S. patent application Ser. Nos. 10/772,134 and 11/216,493, are incorporated herein by reference in their entirety.

FIELD OF THE INVENTION

The invention relates to a system for displaying, pushing, and dividing merchandise on merchandise-display shelves, especially for displaying, pushing, and dividing merchandise on shelves that have limited heights.

BACKGROUND OF THE INVENTION

It is known that retail and wholesale stores, such as drug stores, grocery stores, discount stores, and the like, display frozen products to consumers in freezers with glass doors. In displaying product in such freezers, it is desirable for the product on the shelves within the freezer to be situated toward the front of the shelf so that the product is visible and accessible to consumers. One manner that can be considered to achieve such placement is to use product pusher systems to push the product toward the front of the shelf. However, many freezers, like some other shelving areas in retail environments, can have a limited height between shelves and it can be difficult or impossible to install pusher systems with dividers of significant height in such environments.

While a divider of a lesser height may be acceptable for some environments and for some products, for others, such as bagged frozen foods in a grocer freezer, a lesser height divider is less acceptable. When a display system utilizing a pusher is employed on bagged frozen foods, for example, the products may move laterally over a divider and reduce the effectiveness of the system if the divider is of a lesser height. The bags may be forced by the pusher between the divider and the upper shelf or top wall of the freezer unit, impeding the pusher from advancing additional product to the front of the display. With a divider of a lesser height, the system may not operate efficiently. The present invention, among other things, is directed at overcoming these drawbacks and disadvantages.

SUMMARY OF THE INVENTION

Aspects of the present invention include a multiple component divider and base system used in product management display systems and which can be configured for confined spaces, such as a freezer.

In accordance with an illustrative embodiment of the invention, the multi-component divider can include a first divider component and a connection mechanism for a second divider component. The second divider component can slidably connect to the first divider component when the first divider component is connected to a base. The second divider component can extend above the first divider component, thereby extending the overall height of the divider. The base can be connected to a shelf in a freezer or other location where there is limited space between shelves, yet in applications where a higher divider may be preferred.

In accordance with an illustrative embodiment of the invention, the multi-component divider can be used with a base that may optionally have a track. The track may extend generally from the front of the shelf to the back of the shelf. An optional pusher mechanism may be connected to the track for urging product to the front of the shelf. The optional pusher may be fixed or may have a pusher face that is laterally adjustable to enhance the pushing leverage on wider product.

The present invention combines and improves upon elements from the pending applications by adding a multiple piece divider system. The system starts with an integrated base-and-divider assembly, in which the integrated divider section is less than the full desired height. The base-and-divider assembly combines into a single integrated component, a full-width track, a first divider section, and a narrow track. A narrow and strong end-finisher piece may be used to provide a second multi-piece divider-like partition and, optionally a wide or narrow track, for pairing with a base-and-divider assembly's narrow-track or wide-track portion near an end of either side of a shelf.

In accordance with an illustrative embodiment of the invention, a spring-urged offset pusher may have an upper portion that is offset, via an angled offset portion, from a lower portion of the pusher. The upper offset portion may advantageously extend farther out toward the center of various products to be displayed. Such an offset pusher may allow for using a minimal number of components while still pushing products relatively near to their centers, having the advantage of pushing them smoothly with less binding. When displaying a wide product, one or more supporting tracks, any of which may have a pusher, may be used under the product.

In accordance with an illustrative embodiment of the invention, a base-and-divider assembly may be coupled to a front rail via a complimentary tongue and groove arrangement. Any of the components having a multiple component divider panel, such as a base-and-divider assembly and an end finisher, may also contain any of various engagement mechanisms for non-slidably engaging with a front rail's corresponding engagement mechanism. For instance, teeth on a base may engage corresponding teeth on the front rail. Teeth of this type advantageously allow a base-and-divider assembly, full-width track, and/or end finishers with corresponding teeth to be located at positions virtually continuously along the front rail and may prevent the components from being moved unintentionally from their intended positions during normal shopping activity and shelf re-stocking.

In accordance with an illustrative embodiment of the invention, a base and multiple component divider assembly may include tear-off lines and a break-off line. Such tear-off lines and break-off line combination may be used to advantage to produce one part that may be used for freezer shelves or other limited-height environments having different depths, such as either 16 inches or 10 inches.

In accordance with an illustrative embodiment of the invention, a pusher track may include a depression, which may be used while re-stocking merchandise to hold a pusher near the back of a full-width track or base-and-divider assembly. To use the depression to hold a pusher at the back of the track, a person may move the pusher back to the depression and may tilt the top of the pusher toward the front of the track. Merchandise may be re-stocked without having to manually hold the pusher out of the way. To remove the pusher from the depression, the pusher may be pushed toward the back of the track, the pusher will then return to an upright position and move along the track in its usual way.

In accordance with an illustrative embodiment of the invention, front edges of the respective surfaces that the pusher travels along may automatically engage a bent portion of the pusher's coiled spring when the pusher is inserted onto the front of the track.

In accordance with an illustrative embodiment of the invention the multiple component divider and base system may use a pusher having a straight or offset pusher face, with a flat planar pusher surface or another shape suitable to push specific product packages, such as cylindrical products.

In accordance with an illustrative embodiment of the invention the multiple component divider and base system may use a pusher mechanism having an adjustable pusher panel to accommodate both narrow and wide product without the need to add, remove, or change parts or components of the pusher mechanism or the product display system.

In accordance with an illustrative embodiment of the invention, the multiple component base-and-divider system may include a unique pusher mechanism having an extendable pusher face. The pusher mechanism is mounted to a track that extends generally from the front of the shelf to the back of the shelf. The track is formed in a base that is, in turn, directly or indirectly mounted to a store shelf. The pusher face is transversely extendable relative to the track and is extendable from a retracted position to one of several extended positions. The extended pusher face locates the product pushing surface behind the center or near the center of the wider product, thereby greatly enhancing the pushing leverage on the product.

Additional features and advantages of the invention will be apparent upon reviewing the following detailed description.

BRIEF DESCRIPTION OF THE DRAWINGS

FIG. 4 depicts a front view of the slot and flange of the upper component of the divider of an exemplary embodiment of the present invention.

FIG. 5 depicts another isometric view of an exemplary embodiment of a base and multiple component divider of the present invention.

FIG. 6 depicts an internal view of the slot and flange of the upper component of the divider of an exemplary embodiment of the present invention.

Figure 1:
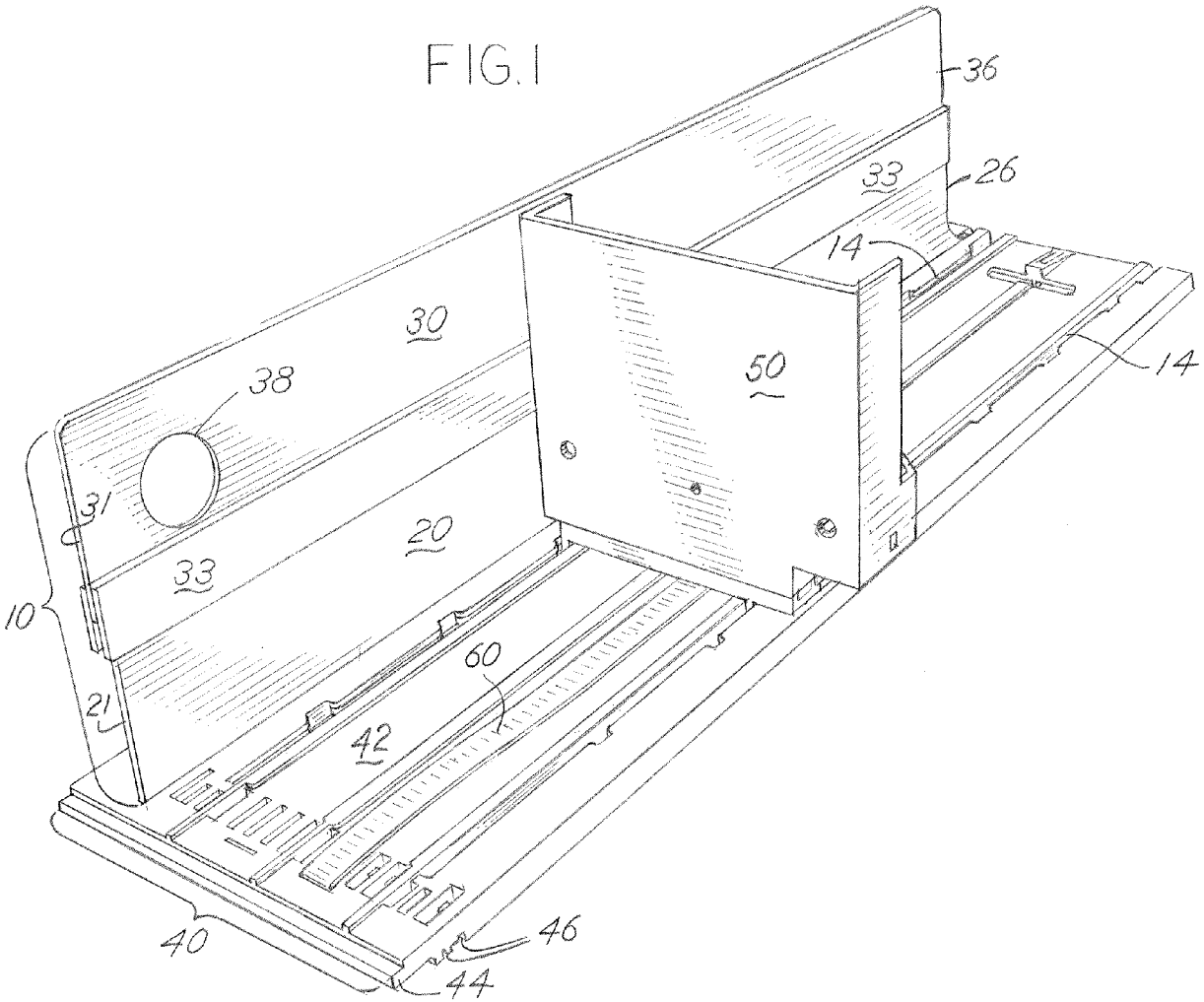
FIG. 1 depicts an isometric view of an exemplary embodiment of a base and multiple component divider of the present invention.

Before some of the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF SOME OF THE EMBODIMENTS OF THE INVENTION

A base and divider system can be used to separate products and retail space into rows. A divider can be integral with a base or can be removably attached to a base. A base and divider can be used in various environments, including on shelving in non-temperate environments and in freezers, coolers or other temperate portions of an environment. Such environments can be retail environments (such as grocery stores, retail stores, pharmacies and other retail environments), displays, storage or non-retail environments. In various environments, such as shelving in a grocer freezer, the base and multiple component divider in operation can extend from near the front of the freezer shelf to near the rear of the freezer shelf.

The divider of the base and multiple component divider system can comprise numerous components. In an embodiment, the divider can comprise two components. In other embodiments, the divider can comprise three, four or more components. With a two component divider, a lower component of the divider can be connected to the base. The lower component can be connected to the base by being formed integral with the base or can be connected to the base through a slot, dovetail, key and lock mechanism or other connection. An upper component of the divider can be connected to the lower component of the divider. In an embodiment, the upper component of the divider can engage the lower component of the divider and also can be disengaged from the lower component of the divider. In an embodiment, the overall height of the divider increases when the upper component of the divider is connected to the lower component of the divider.

The multiple component divider may divide the base into a first portion and a second portion. The first portion of the base may be referred to as a wide portion of the base and the second portion may be referred to as a narrow portion of the base. As will be apparent any suitable ratio of widths may be chosen for the first and second portions of the base. For instance, the multiple component divider may bisect the base such that the base's first and second portions are of a substantially equal width.

A base and multiple component divider system can be placed into an environment in a number of steps. In one embodiment, the base and the lower component of the divider first can be placed into an environment, such as a freezer, and onto a shelf. During installation, the rear portion of the base can be rotated upward in order to allow the front portion of the base to engage a front rail or other connection device that is part of the shelf or has been connected to the shelf. When the rear portion of the base is rotated upward, the lower component of the divider also may be rotated upward. In a constricted environment, this action may bring the lower component of the divider nearer to and in some instances in contact with a ceiling, upper shelf or other upper barrier of the space for the freezer shelf. Once the base in engaged with the shelf connection device, the rear portion of the base can be lowered, which can lower the rear portion of the lower component of the divider.

The upper component of the divider can then be placed in contact with the lower component of the divider. The lower component of the divider can include a groove, slot, furrow, channel, dove tail inset or other structure that assists in contacting the upper component of the divider. The term "groove" shall be interpreted herein to include a groove, slot, furrow, channel, dove tail inset or similar structure. The groove in the lower component of the divider can be placed at or toward the top of the lower component of the divider. In some embodiments, the lower component of the divider can include a plurality of grooves: the lower component can include two, three, or more grooves, depending on the application and desired functioning and properties of the divider. A groove can be placed along the full length of the lower component or can be placed along only a part of the length.

The upper component of the divider can include structure that can be placed in cooperation with the groove, slot, furrow, channel, dove tail inset or other structure of the lower component of the divider. The cooperating structure of the upper component can include a flange, protrusion, rib, tab, extension, dovetail or other structure that assists in bringing the upper and lower components of the divider together. The term "flange" shall be interpreted herein to include a flange, protrusion, rib, extension, tab, dovetail or other like structure. In some embodiments, the upper component of the divider can include a plurality of flanges: the upper component can include two, three, four, five, six, or more flanges, depending on the application and desired functioning and properties of the divider.

In an embodiment, the upper component of the divider can be placed in contact with the lower component of the divider. One or more flanges on the upper component of divider can be placed within or in contact with the one or more grooves of the lower component of the divider. The upper component of the divider can then be slid over the lower component of the divider until the rear portion of the upper component of the divider reaches or becomes closer to the rear portion of the lower component of the divider. Due to the structure of the upper component and lower component of the divider, they can remain in contact with each other and behave in a manner similar to a single unit during operation of the shelf. In an embodiment, the upper component of the divider will not easily be removed from the lower component of the divider unless it is again slid toward the front of the shelf.

The components of the divider also can include a clip, latching mechanism or snap-fit mechanism. An upper (or lower) component of the divider can have a resilient portion near its base. This resilient portion can engage a catch or flange on a lower (or upper) component of the divider such that the upper component of the divider will generally stay in place during normal operation of the divider.

In an embodiment the operation of the upper component and the lower component can be switched. For example, the upper component can contain one or more grooves and the lower component can contain one or more flanges. In such an embodiment, the operation of the upper component and the lower component will behave in a similar manner as the upper and lower components described above. For example, the two components can be connected together when one or more flanges of the lower component are placed within one or more grooves of the upper component.

A base and multiple component divider system can include a pusher track and can be used in cooperation with a pusher, a coil spring, front rail and other structure, components and devices disclosed in U.S. Pat. No. 6,041,720 titled "Product Management Display System," issued on Mar. 28, 2000 and U.S. Pat. No. 4,830,201 titled "Spring-urged Shelf Divider System," issued on May 16, 1989. U.S. Pat. Nos. 6,041,720 and 4,830,201 are both assigned to RTC Industries, Inc., and are incorporated herein by reference in their entirety.

In an embodiment, a base 42 can include a generally flat planar surface which has a front end 40. The base 42 may be configured to engage with or mount onto a shelf, such as a shelf used in a freezer. The base 42 may be connected to a front rail via a complimentary tongue and groove arrangement. The front end 40 of the base 42 can include a tongue 44 or a plurality of tongues and one or more grooves 46. A tongue 44 of the base 42 can engage or come into cooperative contact with a groove in a shelf, a front rail or other structure connected to the shelf. One or more grooves 46 can engage or come into cooperative contact with a tongue in a shelf, a front rail or other structure connected to the shelf. One example of an effective tongue and groove arrangement is the complimentary tongue and groove arrangement of the base and front rail disclosed in U.S. Pat. No. 6,964,235.

Figure 17:
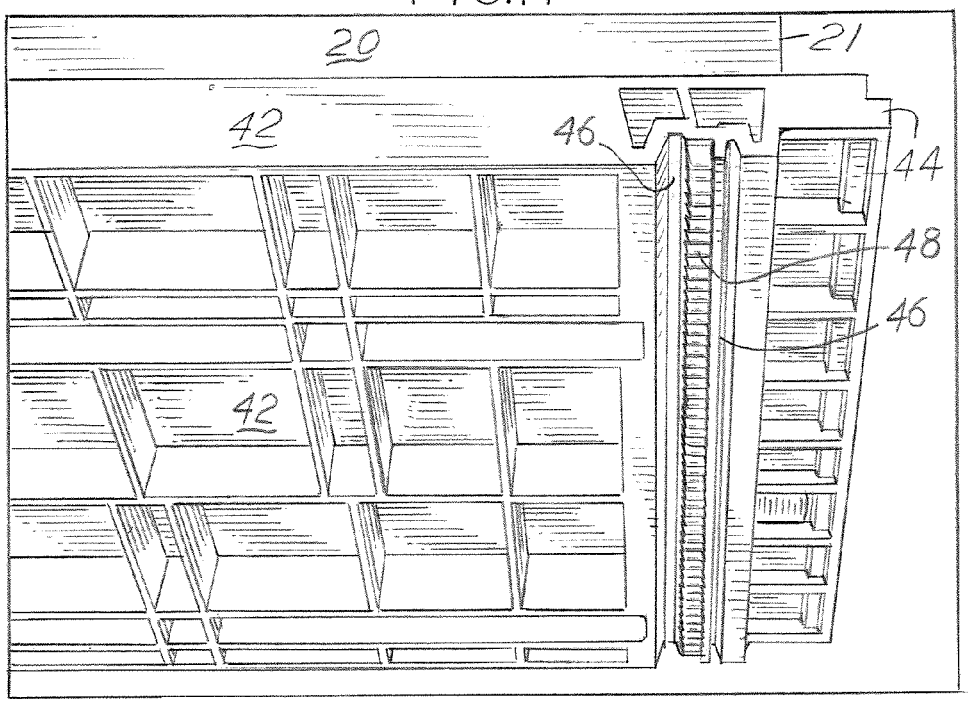
FIG. 17 depicts a perspective view of the bottom front end of the base of an exemplary embodiment of the present invention.
Figure 18:
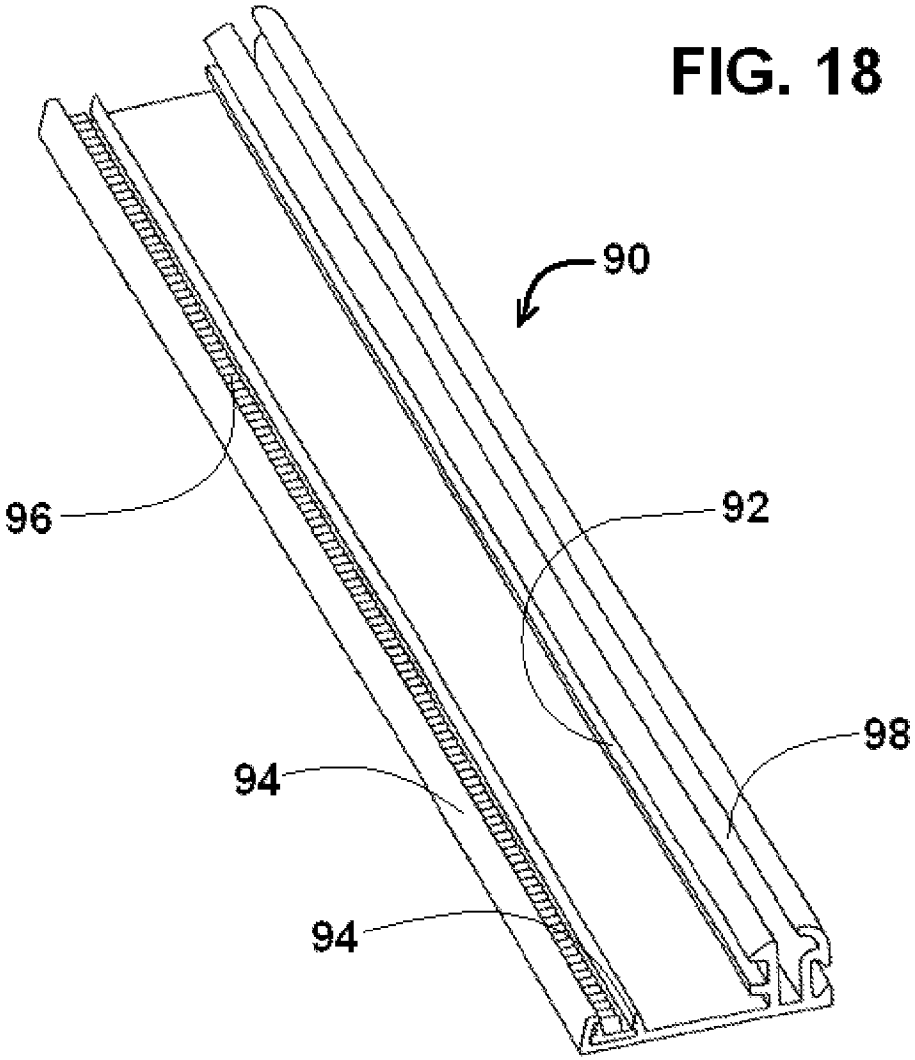
FIG. 18 depicts an oblique side view of the front rail of an exemplary embodiment of the present invention.

In accordance with an illustrative embodiment of the invention, any of the components of the multiple component divider may be coupled to a front rail via a complimentary tongue and groove arrangement as disclosed in U.S. Pat. No. 6,041,720. The base and multiple component divider assembly 400 and full track may non-slidably engage each other. For instance, teeth 48, shown in FIG. 17, may engage a corresponding non-slidable engagement detail in a front rail, such as front rail 90 shown in FIG. 18. FIG. 18 is an enlarged oblique side view of the front rail 90. Teeth 96 allow a base and multiple component divider assembly 400, full-width track, and/or a left-end component with corresponding teeth to be located at substantially continuous positions along the front rail. The mating teeth may be relatively thin and closely spaced to allow for precise placement of pusher-track components. The teeth advantageously prevent the components from being unintentionally moved from their intended positions during normal shopping activity and shelf re-stocking.

As will be apparent, other ways of positively engaging base and multiple component divider assembly 400, full-width track, and/or a left-end component with the front rail may also be used. For instance, serrations on the front rail could bite into the bottom of the pusher-track components. A compression fit arrangement could be used in which a tongue of the pusher-track component snaps into the front rail. The front rail could have rubber in a groove that would receive a serrated tongue of a pusher-track component.

A front rail can assist in connecting the base and multiple component divider to a shelf. The term "connect" as used herein encompasses both direct and indirect connections, mountings, contact and engagement. In an embodiment, a front rail 90 (FIG. 18) can be connected to a shelf, such as a shelf of a freezer. The connection can be aided by bolts, clips, screws, adhesives and other connectors.

The front rail 90 can include one or more grooves 92 and one or more tongues 94. The front rail also can include teeth 96. The teeth can take many configurations and can include numerous thin or thick teeth or can include only a few teeth. The teeth may occur substantially continuously or can occur only in one or more portions of the front rail 90. The front rail also can include a groove 98 which can be used to hold various devices such as a front barrier or wall.

In an embodiment, a divider 10 can be used in conjunction with a base 42. The divider 10 can include two components, a lower component 20 and an upper component 30. The divider 10 can be used to separate merchandised product, such as bagged frozen vegetables or boxed frozen foods, into rows on shelves. The lower component 20 can be affixed to the base 42, can be formed as a unitary structure with base 42 or can be connected (releasably or nonrelaseably) to the base 42 through a connector, including a dovetail, series of flanges and grooves, slot or similar structure. It should be understood by those skilled in the art that variations to the base and lower component of the divider can be made to accommodate the insertion, placement, or removal of the lower component of the dividers, variations that are within the scope of the invention. For example, it may be desirable to provide for slidable engagement of the lower component of the divider with the base. As another example, it should be understood that the lower component of the divider may be formed integral with the base, or snap-fit into the base, such that the lower component of the divider cannot be easily removed from the base.

Figure 2:
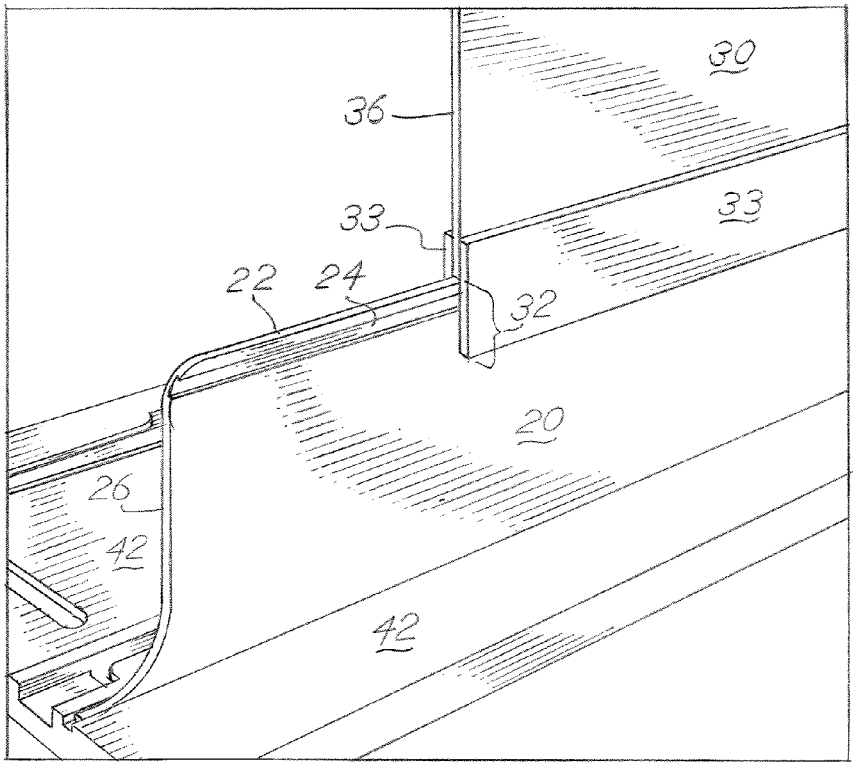
FIG. 2 depicts a view toward the rear of the upper and lower components of the divider during installation of the upper component in an exemplary embodiment of the present invention.

In an embodiment, the lower component 20 of the divider has an upper edge 22. (FIG. 2) Below the upper edge 22 of the lower component of the divider can be located at least one groove 24. The groove 24 can run parallel to the upper edge 22. The groove may be located on either side of the lower component of the divider 20. Grooves also can be located on both sides of the divider. The lower component of the divider, in an embodiment, is of sufficient width 23 to support a groove 24. (FIG. 3) The groove may be located at any distance from the upper edge of the lower component, and can be located near the upper edge of the lower component. Multiple grooves may be located on the same or alternating sides of the lower component, and may be located at the same distance from the upper edge of the lower component or alternatively, may be offset and located at differing distances from the upper edge of the lower component of the divider. Grooves can be horizontal or can be located in non-horizontal, angled or other linear or non-linear patterns. The lower component 20 can include a front end 21 and a rear end 26.

Figure 3:
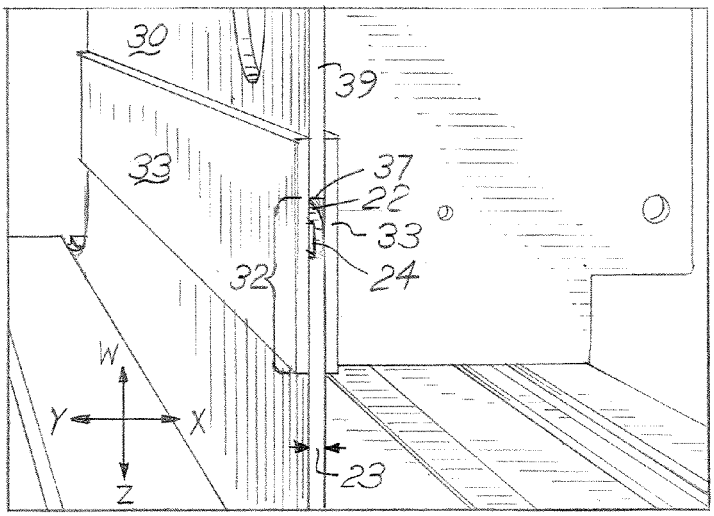
FIG. 3 depicts a front view of the upper and lower components of the divider and slot and groove attachment of an exemplary embodiment of the present invention.

In an embodiment, the upper component 30 can include numerous portions. In FIG. 3, portions of an embodiment of the upper component 30 include side walls 33 and upper portion 39. The side walls 33 and the upper portion 39 can form a slot 32. (FIG. 4) The slot 32 can be made up of side walls 33 that overlap and extend downward past the bottom edge 37 of the upper portion 39 of upper component 30. The side walls 33 can be of any height. The side walls 33 and the upper portion 39 can be formed of a single unitary construction or can consist of individual constructions that have been connected together or otherwise engaged. The upper component 30 can include a front end 31 and a rear end 36.

Figure 7:
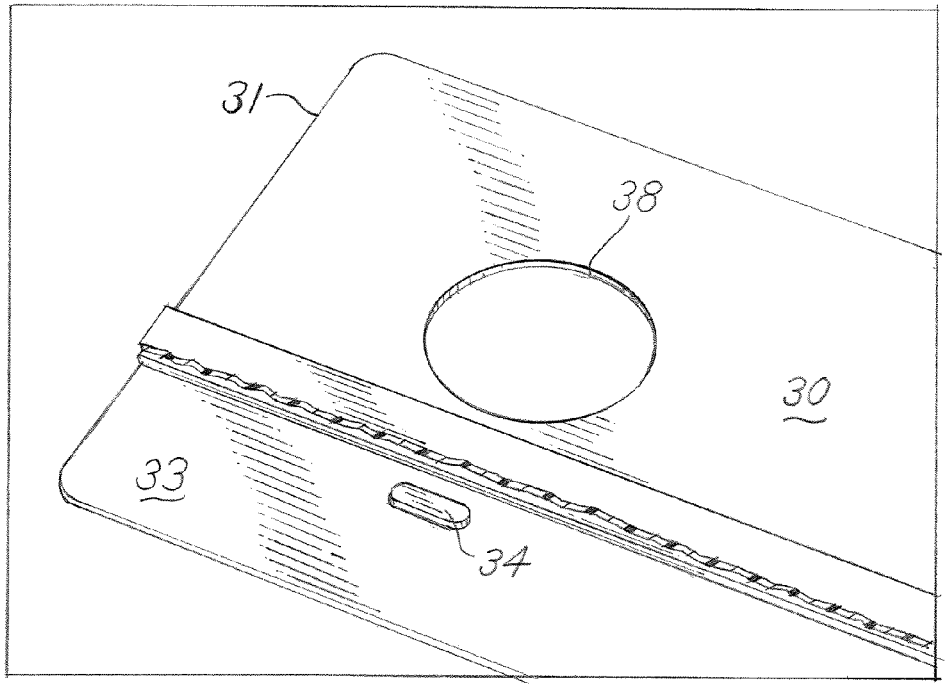
FIG. 7 depicts a view of a flange near the front end of the upper component of the divider of an exemplary embodiment of the present invention, with a portion of the opposite side wall of the upper component cut away.
Figure 8:
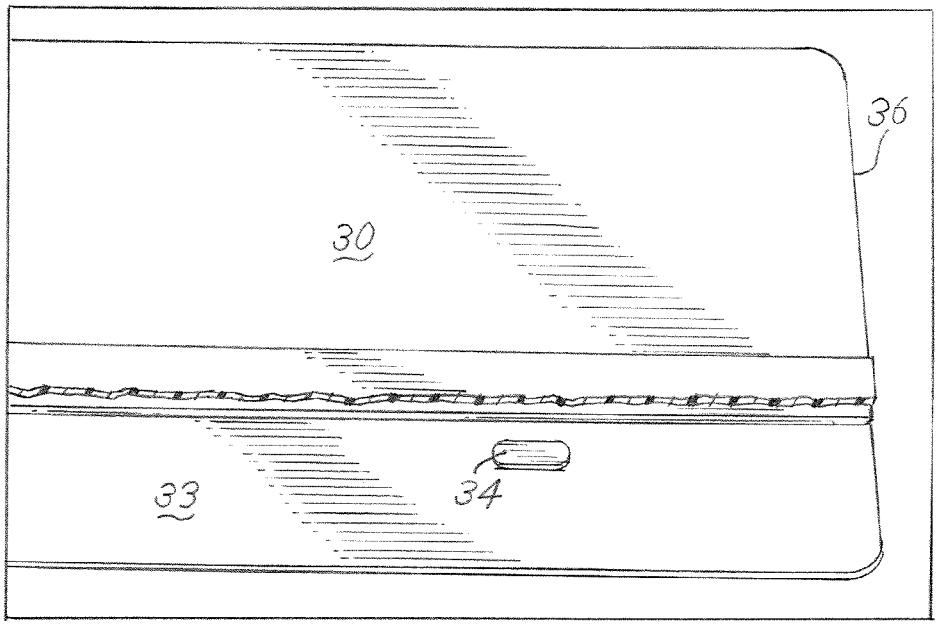
FIG. 8 depicts a view of a flange near the rear end of the upper component of the divider of an exemplary embodiment of the present invention, with a portion of the opposite side wall of the upper component cut away.

The side walls 33 can be sized to align the upper component 30 of the divider 10 and the lower component 20 of the divider 10. The side walls 33 also can be sized to provide rigidity between the upper component 30 of the divider 10 and the lower component 20 of the divider 10. In an embodiment, the side walls 33 can extend over both the upper edge 22 and groove 24 of the lower component 20. (FIG. 3) Within the slot 32 of the upper component 30 and extending into the slot from at least one of the side walls 33 in an embodiment is at least one flange 34. (FIGS. 4, 6, 7, 8) In FIGS. 4, 6, 7 and 8, flange 34 is located on one side wall 33. Flange 34 also can be located on either side wall 33. Flanges also can be located on both side walls 33. The flange can be located within the slot 32 and can operate to engage groove 24 or otherwise be limited in movement by the groove 24 of the lower component 20. One or more flanges 34 can be incorporated into the side walls 33. In an embodiment, two aligned flanges 34 can engage the groove 24 of the lower component 20 of the divider 10 or can otherwise limit or substantially prevent the movement of the flanges in certain directions in relation to the groove. (FIGS. 7 and 8) In other embodiments (not shown), three, four, five, six, or more flanges are incorporated into the side walls 33. In an additional embodiment, the flange can be widened to form a long flange that traverses a portion or substantially all of the side wall 33 and engages a minority, majority or substantially all of the groove 24.

The groove 24 and the flanges 34 can be configured to restrict certain movements of the upper component 30 of the divider 10 in relation to the lower component 20 of the divider 10. When the lower component 20 and the upper component 30 have been connected or placed together, in an embodiment, the side wall 33 can restrict the upper component 30 from moving in the direction shown by the arrow X (FIG. 3); the side wall 33 can restrict the upper component from moving in the direction shown by the arrow Y; the top portion of the flange 34 can restrict the upper component from moving in the direction shown by the arrow W; the bottom portion of the flange 34 can restrict the upper component from moving in the direction shown by the arrow Z. The upper component 30 can also be restricted from moving in the direction shown by the arrow Z by the contact of the bottom edge 37 of the upper component 30 with the upper edge 22 of the lower component 20. In an embodiment, the upper component and the lower component can be configured such that the front edge 31 of the upper divider component and front end 21 of the lower divider component are substantially aligned. (FIGS. 3 and 5) Flanges also may be used as stops to align the front edges of the upper and lower divider components. In embodiments with more than one groove in the lower component of the divider, there may be corresponding flanges in the slot of the upper component of the divider to engage the multiple grooves.

In an embodiment, the upper component 30 of the divider 10 has an aperture 38 through which a finger may be extended to assist in the slidable attachment of the upper component 30 of the divider to, and its removal from, the lower component 20 of the divider. (FIGS. 1 and 5) This aperture can be located near the front edge 31 of the upper component 30. It should be understood that additional alterations in the surface of the upper component 30 near the front edge 31 may allow an individual to better grasp the upper component 30 to assist in the attachment or removal of the upper component 30. In alternative embodiments, a raised area, a rough texture, a ridge or series or ridges or the like, integrally formed with or connected to the upper component also may be used to allow an individual to better grasp the upper component.

In an embodiment, the upper component 30 of the divider 10 can be configured to connect the lower component 20 of the divider. The flange or flanges 34 of the upper component of the divider can engage the groove or grooves 24 of the lower component. In an embodiment, the rear end 36 of the upper component 30 initially is aligned with the front end 21 of the lower component 20. The flange or flanges 34 of the upper portion are aligned to fit within the groove 24. With the flange or flanges 34 in the groove 24, the upper component 30 initially can be configured to be slidable in relation to the lower component 20, such that the flanges 34 can slide within the groove 24. The upper component 30 can slide in relation to the lower component 20, in various embodiments, until the rear end 36 of the upper component 30 is aligned with or near the rear end 26 of the lower component 20 or until the flange reaches the end of the groove and stops. In addition, the front end 31 of the upper component can be aligned with or near the front end 21 of the lower component 20 when the flange 34 is in contact with (such as through engagement) the groove 24. When the upper component 30 has been slid over the lower component 20 and the flange or flanges 34 are in contact with the groove or grooves 24, movement of the upper component in the directions indicated by the arrows W, X, Y and Z (FIG. 3) is restricted or prevented.

Figure 9:
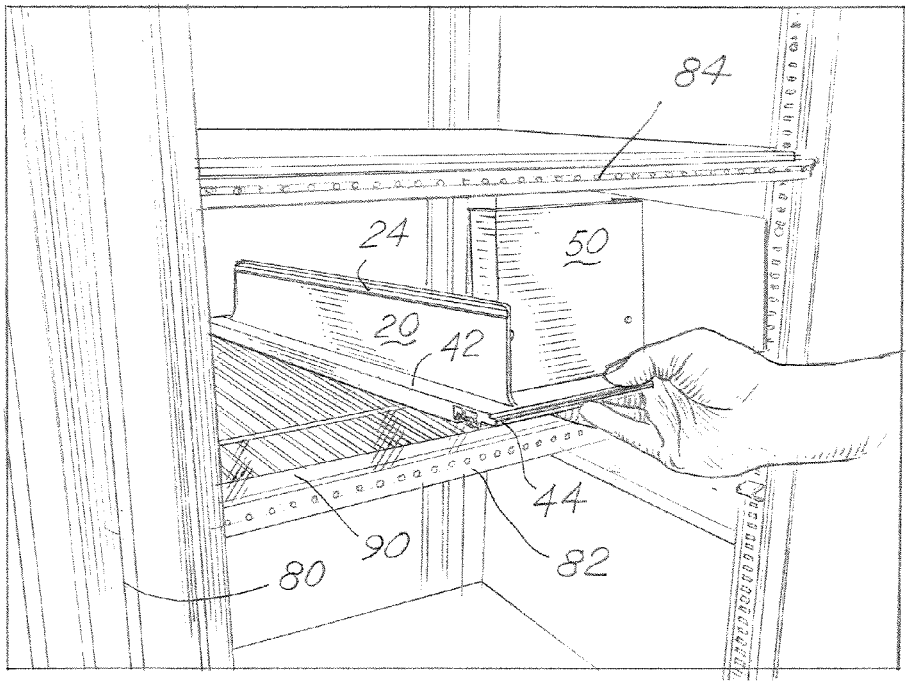
FIG. 9 depicts an exemplary embodiment of a base and multiple component divider of the present invention being positioned for installation on a freezer shelf
Figure 10:
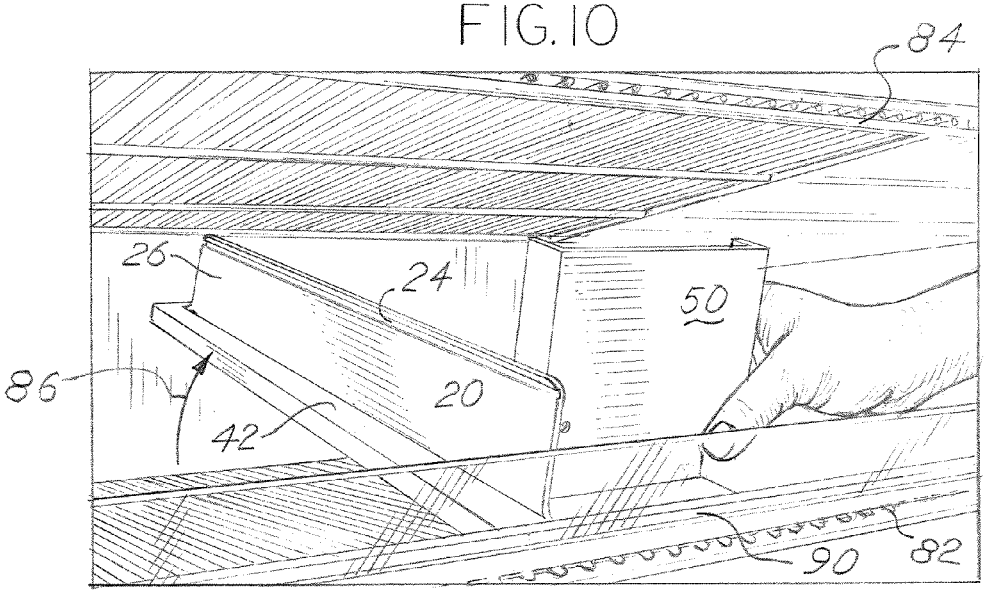
FIG. 10 depicts an exemplary embodiment of a base and multiple component divider of the present invention being angled to engage the base in the front rail for installation on a freezer shelf.
Figure 11:
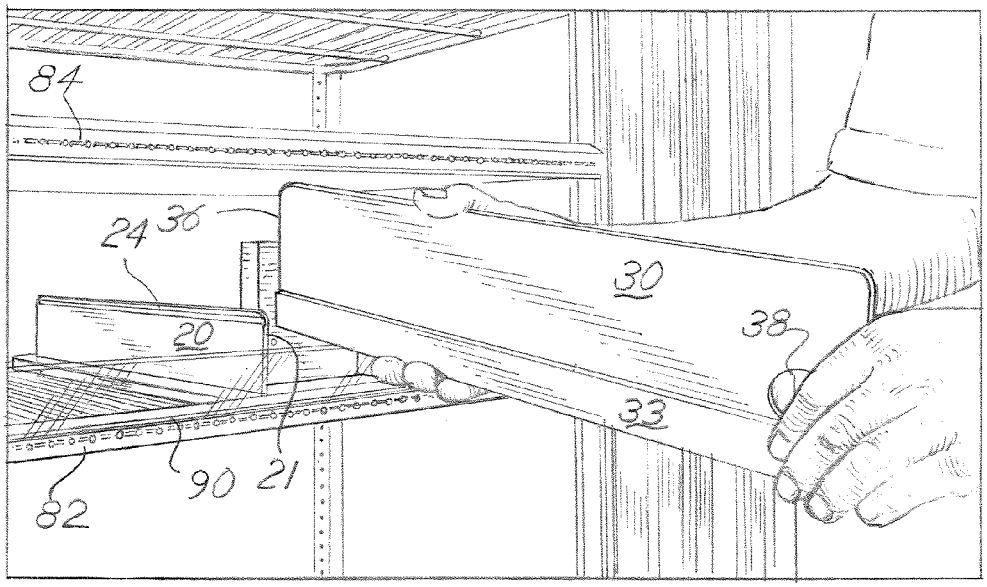
FIG. 11 depicts the upper component of the divider of an exemplary embodiment of the present invention being aligned with the lower component of the divider for installation.
Figure 12:
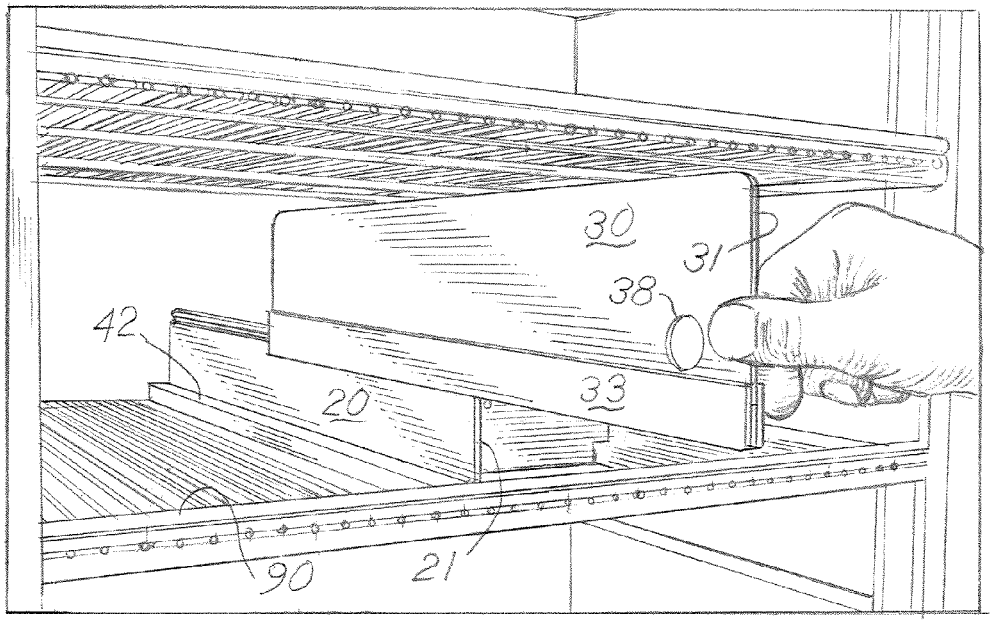
FIG. 12 depicts the upper component of the divider of an exemplary embodiment of the present invention being installed and slidably engaged on the lower component of the divider.
Figure 13:
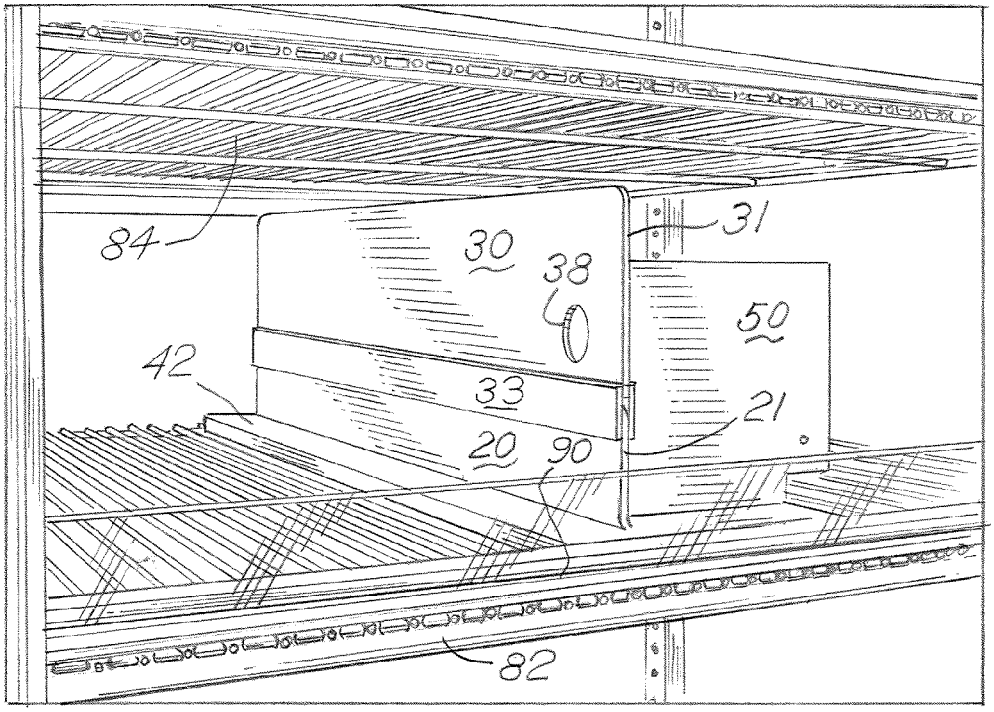
FIG. 13 depicts the upper component of the divider of an exemplary embodiment of the present invention installed on the lower component of the divider.
Figure 16:
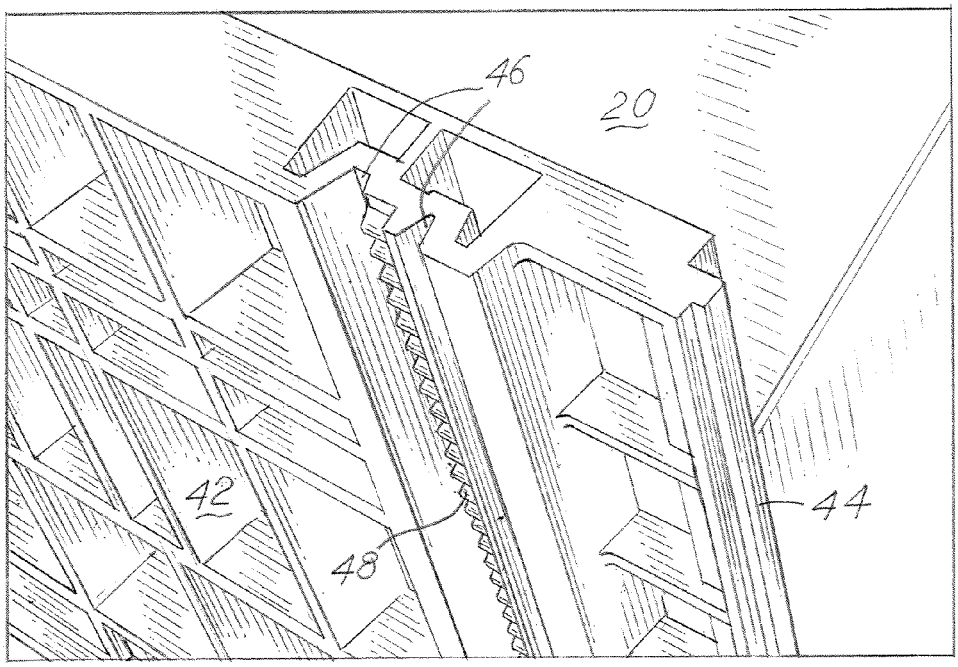
FIG. 16 depicts a close up perspective view of the bottom front end of the base of an exemplary embodiment of the present invention.

In an embodiment, the base and multiple component divider can be put in place in a retail environment, such as a grocery freezer 80 (FIG. 9) by initially placing the base 42 and lower component of the divider 20 into the freezer 80. To engage the base 42 to a front rail 90, the rear potion of the base and the rear end 26 of the lower component of the divider 20 may be rotated upward in the direction of the arrow 86 (as shown in FIG. 10). By rotating the rear portions upward, the tongue 44 can be inserted into a groove in the freezer shelf 82 or into a groove 92 in a front rail 90 that is connected to a freezer shelf. The base and lower component of the divider can then be rotated downward, which can allow one or more grooves 46 to come into contact with one or more tongues 94 on a front rail. In an embodiment of the invention, the front rail can contain teeth 96 and the underside of the base can contain teeth 48. FIGS. 16 and 17 show an embodiment of the underside of base 42 and the teeth 48 and grooves 46. The teeth of the front rail or the teeth of the base can take on many configurations and can include numerous thin or thick teeth or can include only a few teeth. The teeth may occur substantially continuously or may occur only in one or more portions of the front rail or the base. Where the underside of the base includes teeth and the front rail includes teeth, teeth of both the base and the front rail can come into contact with each other when the rear portion of the base and divider is rotated downward. The contact between the teeth can inhibit the base and divider from moving in certain directions in relation to the front rail. FIGS. 11-13 show one embodiment of the base and multiple component divider rotated downward and engaged with a front rail.

In an embodiment, an upper component 30 of the divider 10 can be installed once the base 42 and lower component 20 of the divider are installed in the freezer shelf. The upper component 30 can be arranged such that the one or more flanges of the upper component 30 are aligned with the one or more grooves in the lower component 20. FIGS. 11, 12 and 13 show one embodiment of an upper component 30 being placed in contact with a lower component 20 of the divider.

The full height of the divider 10 can be greater when the upper component 30 and the lower component 20 are engaged with each other (as shown in FIGS. 11-13). The full height of the divider 10 can reach to the bottom portion of an upper barrier such as an upper shelf 84 or a ceiling of the freezer 80. In an embodiment, the base and multiple component divider assembly can reach from a lower shelf 82 to an upper barrier such as an upper shelf 84 of a freezer 80. In another embodiment, the divider 10 may not extend entirely to the upper barrier (such as shelf 84) but can approach the barrier. In another embodiment, the divider 10 (including the upper component 30) may extend up to one, two or three inches below an upper barrier, such as upper shelf 84.

Figure 15:
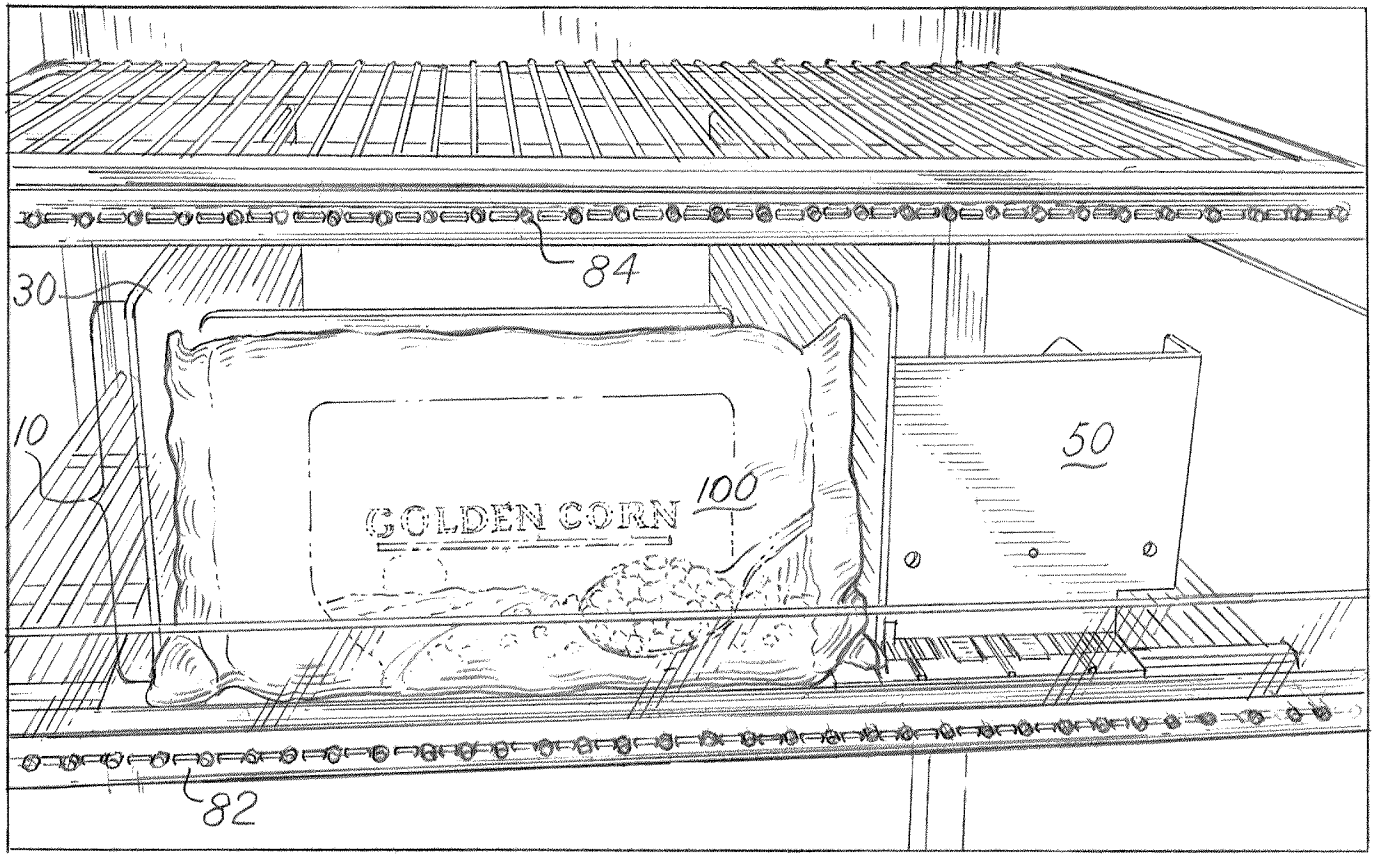
FIG. 15 depicts a bagged frozen food product displayed between two examples of base and multiple component dividers of the present invention installed on a freezer shelf.

In an embodiment of the invention, a product, such as product 100 shown in FIG. 15, can be placed on the base 42. This product can include product which does not have a fully uniform or rigid shape, such as packages of frozen vegetables. The height of the divider 10 when the upper component 30 and the lower component 20 have been installed can extend beyond the height of the product 100. The height of the divider 10 also can extend to near the height of a retail product. By extending the height of the divider 10 beyond the height of the retail product, the likelihood is lessened that the retail product will bind or become stuck on the divider, such as by a portion of the retail product moving over or on top of the divider. By extending the height of the divider 10 near to the height of the retail product, this likelihood is lessened but is not lessened as much in some embodiments as when the height of the divider extends beyond the height of the retail product.

Figure 14:
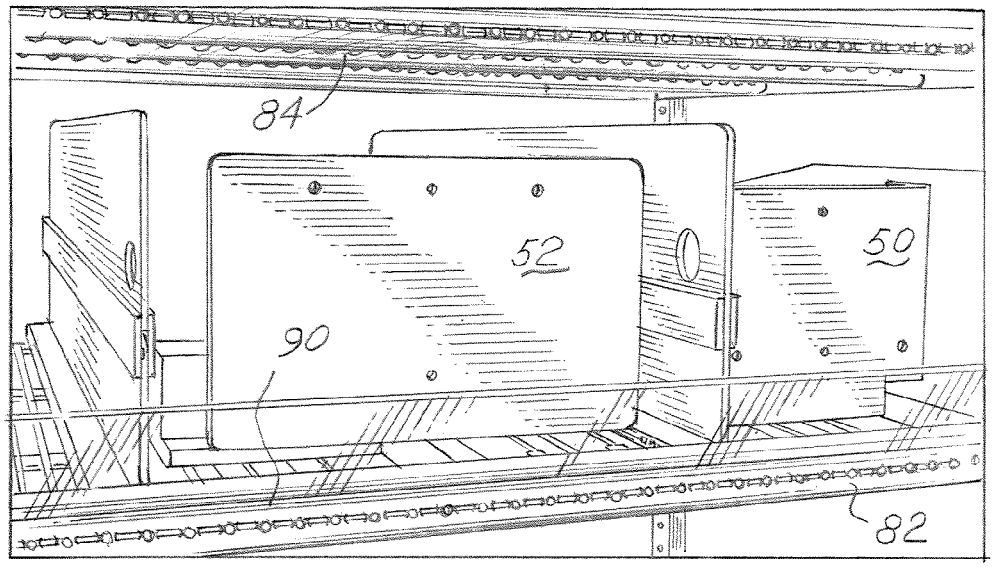
FIG. 14 depicts two examples of base and multiple component dividers of the present invention, with pushers of different widths installed on a freezer shelf.
Figure 20:
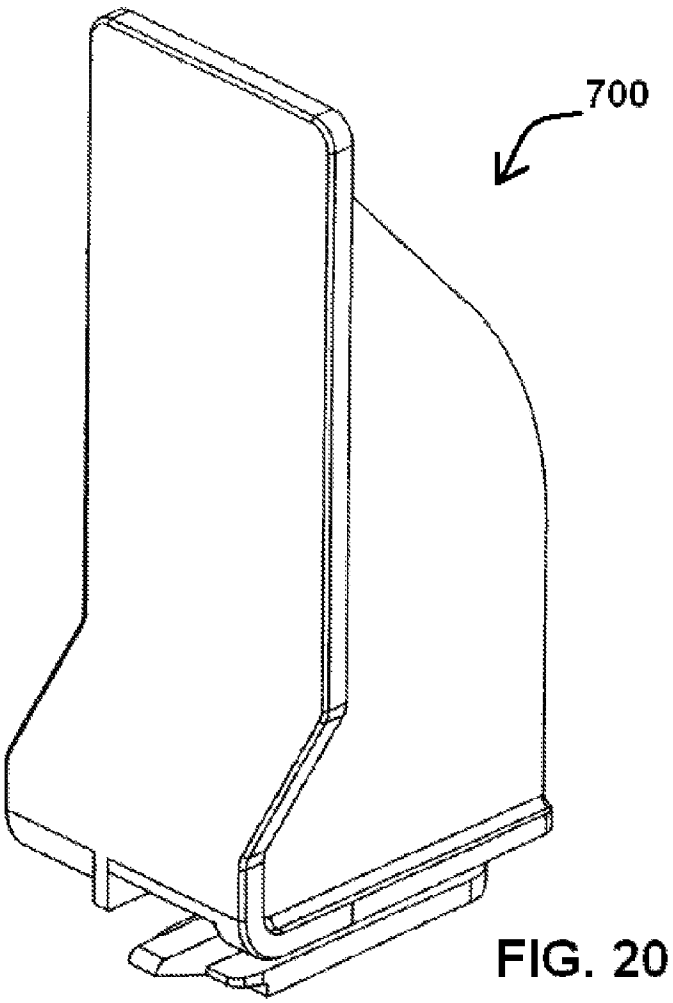
FIG. 20 shows an offset pusher in accordance with an illustrative embodiment of the invention.

In an embodiment, several base and multiple component divider systems can be used in the same retail environment. As shown in FIGS. 14 and 15, a plurality of base and divider systems can create rows or channels in which products can be placed. In addition, pushers with pusher faces of various dimensions (e.g., 50 and 52) can be used. Wider and taller pushers faces, such as pusher face 52 can be used to push wider and taller products and narrower pushers or pusher faces can be used to push narrower products. Pushers with offset faces 700 (FIG. 20) may be used in some embodiments. In an embodiment the width of the pusher is greater than the width of the product being pushed. In another embodiment, the width of the pusher is at least 75% of the width of the product being pushed. In an embodiment, a pusher urging element 360, such a coil spring can be used to urge the pusher or pusher mechanism forward.

In an embodiment, the upper component 30 of the divider is of uniform height along the entire length of the component. In an embodiment, the lower component of the divider is of uniform height along the entire length of the component. The height of the upper component and the lower component may vary depending on the overall height of the divider required. Moreover, one skilled in the art will appreciate that the shape of the upper component and lower component of the divider is not limited to the shape depicted in the Figures. Rather, the upper component and lower component of the divider shape may define any shape, profile or contour that enhances the placement and removal for product on the shelf.

In an embodiment, a multiple piece divider includes lower component 20 that extends outwardly from a base 42, and an upper component 30 removably attached to the lower component 20. (FIG. 1) While the multiple piece divider 10 that is depicted in FIG. 1 extends upward from the base 42, one of skill in the art will understand that the multiple piece divider 10 may be configured such that the base 42 is mounted as a side wall or a top wall or ceiling such that the multiple piece divider 10 and other components such as a pusher mechanism 50 would extend sideways or downwardly from the base 42. The present invention is therefore not to be limited to the single multiple piece divider 10, nor the upright divider configuration, depicted in the Figures, as the multiple piece divider 10 is simply illustrative of the features of the invention.

In an embodiment, at either end of a shelf using multiple piece divider, base and pusher components, a narrow and strong multiple piece end-finisher component is desirable. A right-end component may be fastened to a shelf near the right-hand side of the shelf. The right-end component's divider may act the right-most divider on the shelf. In a height-restricted environment such as a freezer, the right end-finisher component may be a multiple piece divider. The right-end component may be operatively coupled to a shelf by inserting pegs through corresponding holes in a shelf. One or more fasteners, such as plastic push-rivets, may be used through holes through corresponding holes in a shelf, to securely fasten the right-end component to the shelf. Optionally, the right-end component may be coupled to a front rail via a complimentary tongue and groove arrangement and may have a plurality of teeth that engage a corresponding non-slidable engagement detail in a front rail.

A left-end component may be similar to a base and multiple component divider assembly 400 except that, for the left-end component the portion of the base and divider assembly's base to the left of the divider is omitted. Accordingly, for use in height-restricted environment such as a freezer, the left-end component may include a multiple component divider and a base portion. Because the right-end component is intended to have a fixed location and the other components may have adjustable positions along a rail near the front of a shelf, components may be placed onto the shelf and the front rail from right to left to allow for maximum flexibility in adjusting the distances between the components.

Occasionally a product is too wide to use only base and multiple component divider assemblies 400 on either side of the product. Under these circumstances, one or more supporting tracks may be used under the product. In addition, a product may be unusually dense and/or heavy such that the product requires another track with an additional pusher to move the product. Under these circumstances, a full-width track and also referred to as a base, may be used either with or without a pusher.

Figure 21:
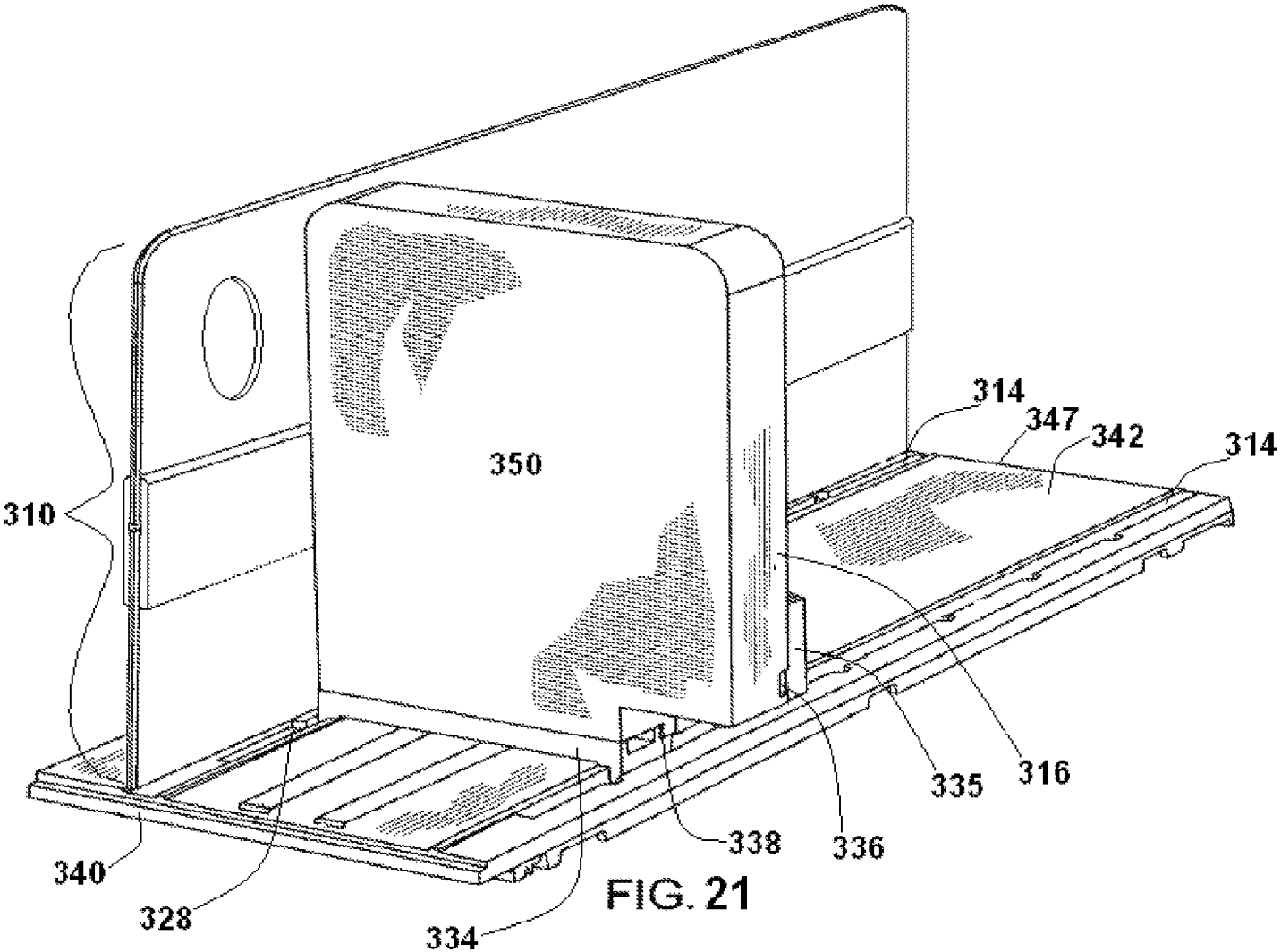
FIG. 21 depicts another isometric view of an exemplary embodiment of a base and multiple component divider of FIG. 1.
Figure 22:
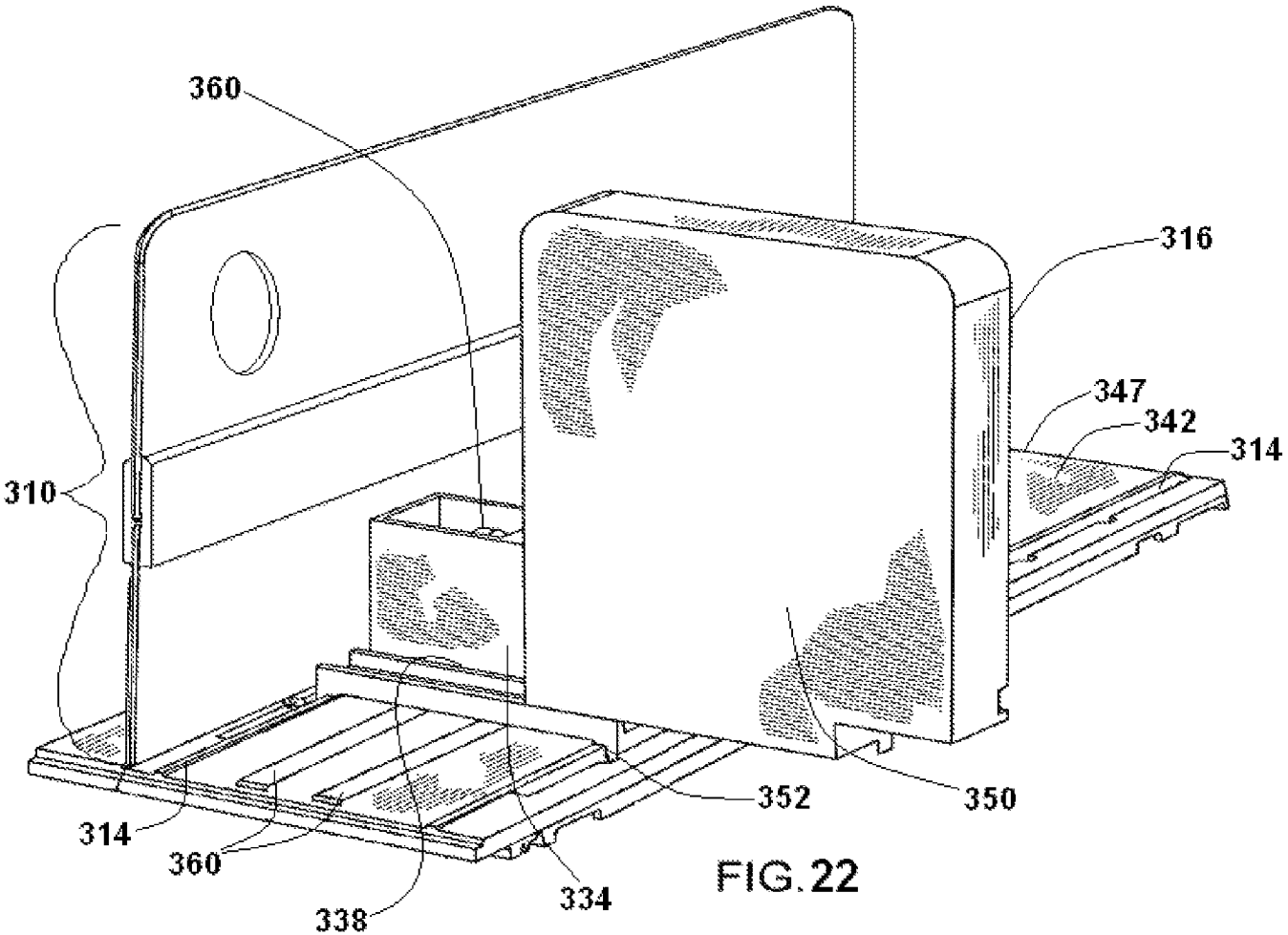
FIG. 22 depicts another isometric view of an exemplary embodiment of a base and multiple component divider of FIG. 1.

Alternatively, a pusher mechanism may be used that includes the ability to be slidably configured to push narrow product and also wide product. The pusher mechanism 316 achieves these multiple configurations, without the use of separate, additional components by providing a pusher face 350 that can slide along the base and extend transversely relative to the track 314. This transverse movement of the pusher face 350 is best illustrated by FIGS. 21 and 22. As depicted in FIG. 21, the pusher face 350 is shown retracted toward the multiple component divider 310. In this position, the pusher face 350 will properly push narrower product and some wider product, depending on the shape, size, and configuration of the product. As depicted in FIG. 22, the pusher face 350 is shown extended away from the multiple component divider 310 or, in other words, moved transversely relative to the track 314. In this position, the pusher face 350 will be in a wide product pushing position to properly push wider product, depending on the shape, size and configuration of the product, as the pusher face 350 will now be positioned toward the center of the product. In this pusher face position, the pushing leverage of the pusher mechanism is greatly enhanced. As will be explained in greater detail below, the pusher face 350 is incrementally adjustable to numerous positions between the retracted position and the fully extended position. Advantageously, this incremental adjustment feature permits the selective adjustment of the pusher face 350 to accommodate and properly push nearly any product normally merchandised on the shelf regardless of its size, shape, and configuration. This selective adjustment permits the user to locate the pusher face 350 at or near the center of the product, or otherwise optimize the pushing leverage of the pusher mechanism on the product.

As stated above, the transversely adjustable pusher mechanism 316 includes the ability to push narrow product and to be slidably configured to multiple positions to also push wider product. The pusher mechanism 316 achieves these multiple configurations and positions by providing a pusher face 350 that can slide transversely relative to the track 314 to one of a multitude of pusher face positions. The pusher mechanism 316 is also slidably mounted on a base 342 defining the track 314. A multiple component product divider 310 that extends outwardly from the base 342 to divide and organize product on the shelf. While the system is depicted as a single base 342, pusher mechanism 316, and multiple component divider 310, one of skill in the art will understand that multiples of these components are often used in stores and in various configurations. In addition, it should be understood that the system may be configured such that the base 342 is mounted as a top wall or ceiling such that the pusher mechanism 316 and multiple component divider 310 would extend downwardly from the base 342. The present invention is therefore not to be limited to the upright pusher and multiple component divider configuration, depicted in the Figures, but rather is simply illustrative of the features of the invention In an exemplary embodiment, the pusher face 350, also known as a pusher paddle, extends outwardly from the base 342. The pusher face 350 can define generally a flat planar pusher surface or another shape suitable to pushing specific product packages such as cylindrical products. The pusher face 350 further defines a thickness suitable for pushing wider, heavier product without experiencing undue bending. The pusher face 350 may be made of any known material, such as a plastic material, that is suitable for pushing product. In some embodiments, pusher faces of various dimensions (e.g., 50 and 52) can be used. Wider pusher faces, such as pusher face 52 can be used to push wider products.

Figure 23:
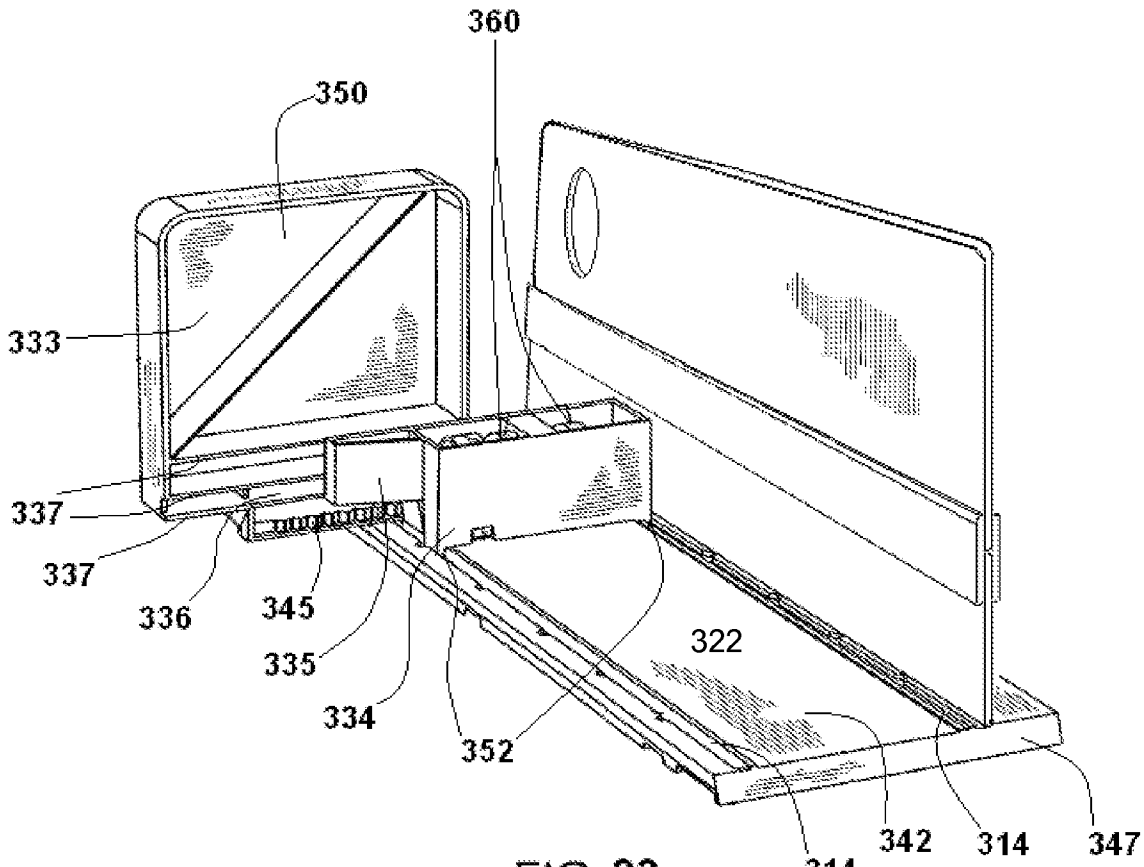
FIG. 23 depicts another isometric view of an exemplary embodiment of a base and multiple component divider of FIG. 1.

The pusher face 350 is coupled to the track 314 through the use of a pusher support base 334, as illustrated in FIG. 23. The pusher face 350 is slidably mounted to the support base 334 along a support track 336 (FIGS. 21 and 23) and a support track 338 (FIGS. 21 and 22), both of which provide a point of engagement for the pusher face and also permit the pusher face 350 to slide in a generally horizontal manner. The pusher face 350 is mounted to the support base 334 at these points of engagement to provide a secure connection of the pusher face 350 to the support base 334. One skilled in the art will appreciate that other techniques for mounting the pusher face 350 to the pusher support base 334 are possible and that the support tracks 336, 338 are simply illustrative of an exemplary embodiment.

In an exemplary embodiment, and depicted in FIG. 23, located along the back side 333 of the pusher face 350 are a plurality of detents 345 that engage with a biased extension mounted to the support base 334. The biased extension and the detents 345 permit the incremental movement of the pusher face 350 and serve to hold the pusher face 350 in a desired position after the pusher face 350 is slid relative to the support base 334 and therefore relative to the tracks 314. In other words, as the pusher face 350 is slid along the support tracks 336, 338 of the support base 334, the biased extension moves across the plurality of detents 345 seating and reseating in the plurality of detents 345 until the pusher face 350 is at the desired position. Once at the desired position, the biased extension will seat in the detent 345 and hold the pusher face 350 in that position.

The pusher face 350 is slidably mounted to the support base 334, as described above, to slide transversely relative to the tracks 314. The slidable adjustment of the pusher face 350 permits the user to extend the pusher face 350 from a retracted position, as depicted in FIG. 21, to one of several extended positions, as depicted in FIG. 22, preferably a position that ensures the pusher face 350 is aligned with the center of the product (or any other desirable position) to properly push the product. This selective adjustment of the pusher face 350 to the center of the product (or any other desirable position) greatly enhances the pushing leverage of the pusher face 350 on the product, without the user having to change out the pusher face, add an additional track, widen the spacing between the tracks 314, or add a second pusher mechanism or other components.

As stated, the pusher face 350 will be held in the desired pusher face location by the biased extension and the detents 345. One of skill in the art will understand that other variations to the described technique of holding the pusher face 350 in any of the transversely extended positions are possible and are considered within the scope of the invention including, without limitation, techniques using pins, clips, fasteners, springs, clamps, or other securement and attachment techniques known in the art. In addition, it is contemplated that the present invention may be used without the holding techniques described herein; rather, the pusher face may be slidably extended through any known techniques and held in place by friction alone. Moreover, one skilled in the art will understand that other techniques to transversely extend the pusher face to a wide product pushing configuration are possible, including the use of different track 336, 338 configurations, tongue and groove techniques, and the like. In addition, it is contemplated that the pusher face 350 may incorporate a pusher face extension that extends transversely outward from the pusher face 350 to provide a wider pushing surface. The pusher face extension may be incorporated onto the pusher face 350 through the use of any technique described herein.

The support base 334 defines outwardly extending flanges 352 used to slidably mount and secure the support base 334 to one or more tracks 314. The support base 334 defines a sufficient width and depth to provide the pusher face 350 with a support foundation that will allow the pusher face 350 to properly push wider and often heavier product on the shelf without the undesirable binding of the flanges 352 in the tracks. Also, in an exemplary embodiment, the outwardly extending flanges 352 are spaced apart on the support base 334 and therefore spaced apart in the tracks 314 to provide a support foundation that will prevent bending or tipping of the pusher face 350 as it pushes the wider and often heavier product. One of skill in the art will appreciate that the number, positioning and spacing of the flanges 352 will vary depending on the desired application and the size of the product being pushed. Therefore, it will be readily understood that the present invention is not limited to the number, spacing and positioning of the flanges 352 illustrated by the exemplary embodiment depicted in the Figures.

The support base 334 also defines a base extension 335 that serves as a support structure for the mounted pusher face 350. The base extension 335 is depicted as protruding outwardly from the support base 334 and across the back side 333 of the pusher face 350 and along pusher face support ribs 337. The base extension 335 will provide support for the pusher face 350 in the retracted position, or in any of the extended positions. The base extension 335 may be formed integral with the support base 334 or may be attached to the support base 334 using known attaching techniques.

The support base 334 also serves to contain at least one pusher urging element 360 used to urge the pusher face 350 toward the front of the shelf. The pusher urging element 360 may be any biasing element including, without limitation, a flat coil spring commonly used with pusher systems. The present invention may use one or more pusher urging elements 360 to urge the pusher face 350 depending on the desired application. The pusher urging element 360 may be mounted to the pusher mechanism 316 and the base 342 using any known mounting technique. In the exemplary embodiment, one end of the pusher urging element 360 is secured to the base 342 near the front edge 340 of the base 342, and the opposing end of the pusher urging element 360, which is depicted as a coiled end, is positioned behind the pusher mechanism 316 to urge the pusher face 350 toward the front of the shelf, as known in the art.

Other mounting configurations of the pusher urging element 360 are possible with the present invention. In other words, the fixed end of the pusher urging element 360 may be mounted to the pusher mechanism 316, while the other coiled end may be operatively mounted to the base or other structure.

In addition, other techniques for mounting the pusher urging element 360 to the base 342, the pusher mechanism 316, or other components are possible with the present invention, including the unique mounting technique shown and described in published application PCT/IB03/01088, assigned to RTC Industries, Inc., and incorporated herein by reference. With that mounting technique, the end of the pusher urging element defines a V-shape and has a predetermined spring resiliency such that under an applied load the V-shaped end will compress and will return to its original shape upon the removal of the applied load. During installation, the V-shaped end will be pressed into a channel formed in the base and will compress as the end passes into the channel. Once in the channel, the V-shaped end will release and will snap fit into the channel, thereby securing the pusher urging element to the base. To release the pusher urging element from the channel, one must simply press on the V-shaped end until the V-shaped end passes back through the channel. The pusher urging element may then be lifted up and out of the channel. For more detail concerning this unique mounting technique, reference should be made to published application PCT/IB03/01088.

In an exemplary embodiment, the base 342 defines a generally flat planar surface 322, as illustrated in FIG. 23, that may be configured to engage with or mount onto any known shelf used in a store, and in any known mounting configuration and orientation. As depicted, the base 342 defines a front edge 340, a back edge 347, and track 314 extending along the base 342 from the front edge 340 to the back edge 347. As illustrated, two tracks 314 can be used with each pusher mechanism and are spaced apart to mount the pusher mechanism 316. It should be understood that more or less than two tracks could be used with the invention, depending on the particular application. The track 314 forms a groove or channel 328 in the base 342 that is sized and shaped to receive a mating flange of the pusher mechanism 316, described below. When viewed from either the front edge 340 or the back edge 347 of the base 342, the exemplary groove 328 can generally define an "L" shaped configuration. This configuration permits the flange of the pusher mechanism 316 to slidably mount to the base 342 and yet prevents the pusher mechanism 316 from lifting out of the track 314. Note that other shapes of the groove 328 are possible with the invention to mount the pusher mechanism 316 to the base 342.

Figure 19:
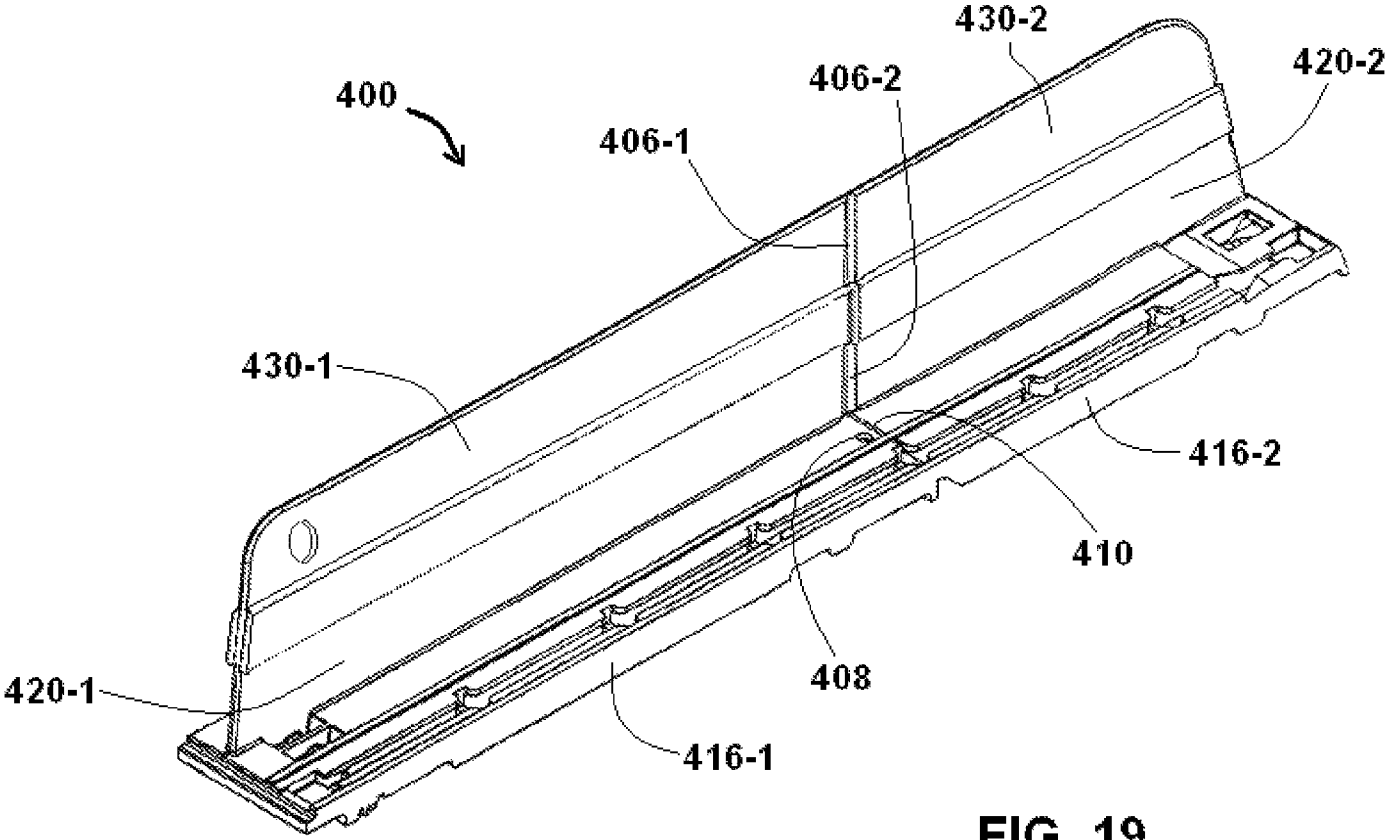
FIG. 19 depicts an isometric view of an integrated base and multiple component divider assembly without a pusher in accordance with an illustrative embodiment of the invention.

Referring again to FIG. 19, the base and multiple component divider assembly 400 may optionally include tear-off lines, such as tear-off lines 406-1 and 406-2, and a break-off line, such as break-off line 410. Such tear-off lines and break-off line combination may be used to advantage to produce one part that may be used for shelves having different depths, such as either 16 inches or 10 inches. Tear-off line 406-1 allows tearing of the upper component divider pieces 430-1 and 430-2 as a first operation. Tear-off line 406-2 allows tearing of the lower component divider pieces 420-1 and 420-2 as a second operation. These tearing operations may proceed in any order and are then be followed by a breaking operation to separate track piece 416-1 from track piece 416-2. The combination of the tear-off lines and the break-off line facilitates removal of the rear portion of the base and multiple component divider assembly 400.

After removing the rear portion of the base and multiple component divider assembly 400 or any other base that may accept a pusher 700 or pusher mechanism, the pusher or pusher mechanism may be prevented from sliding out of the back of the pusher track by inserting a pin into a hole located on the remaining portion of the base. In an embodiment a pin may be molded into the bottom rear portion of a base 416-2.

In an embodiment, a depression may be used, while restocking merchandise, to hold a pusher near the back of a track or a base and multiple component divider assembly 400. To use the depression to hold a pusher 700 at the back of the track a person may move the pusher 700 back to the depression and may tilt the top of the pusher 700 toward the front of the track. The depression then holds the pusher 700 so that merchandise may be re-stocked without having to manually hold the pusher out of the way while placing the merchandise on the track surface. To remove the pusher 700 from the depression, the pusher may be pushed toward the back of the track, the pusher will then return to an upright position and move along the track in its usual way.

The following example is an illustrative example of an embodiment of aspects of the invention.

EXAMPLE

A divider for dividing displayed merchandise into rows comprises a base connected to a shelf. The base includes at least one track to which a pusher is operatively connected. The pusher has the ability to move along the track and the pusher includes a pusher base and a pusher face mounted to the pusher base. The divider includes a lower divider component and an upper divider component. The lower divider component extends outward from the base and the lower component has a groove located below and parallel to at least a portion of the upper edge of the lower component. The upper component has a flange that slidably engages the groove of the lower component. The groove and flange are positioned to restrict the movement of the upper component when the front ends of the upper component and lower component are in substantial alignment. An aperture is located in the upper component to facilitate the installation and removal of the upper component.

A base and multiple component divider system can include a pusher track and can be used in cooperation with a pusher, a coil spring, front rail and other structure, components and devices disclosed in U.S. Pat. No. 6,041,720 titled "Product Management Display System," issued on Mar. 28, 2000 and U.S. Pat. No. 4,830,201 titled "Spring-urged Shelf Divider System," issued on May 16, 1989. U.S. Pat. Nos. 6,964,235, 6,041,720 and 4,830,201 and U.S. patent application Ser. No. 10/772,134, are all assigned to RTC Industries, Inc., and are incorporated herein by reference in their entirety.

Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A multi-component divider display system, comprising:

a base for operative coupling to a shelf, wherein the base includes at least one pusher track;

a divider for dividing displayed merchandise into rows comprised of at least two components, including a first divider component and a second divider component, wherein the first divider component extends outwardly from the base and the second divider component comprises at least one flange, said flange being positioned to slidably engage at least one cooperating groove on the first divider component such that the second divider component is releasably connected to the first divider component;

a spring-urged pusher in the pusher track of the base, wherein the pusher is movable in a first direction, the pusher including a pusher face that is linearly slidable along a planar, horizontal direction from a first position to at least one second position, wherein the planar, horizontal direction is substantially perpendicular to the first direction.

2. The multi-component divider display system of claim 1 wherein the pusher track and the base and first divider component form a unitary, one-piece construction.

3. The multi-component divider display system of claim 1, wherein the base is operatively coupled to a shelf via a front rail.

4. The multi-component divider display system of claim 1, wherein the base is operatively coupled to a shelf via a rail that is affixed to the shelf.

5. The multi-component divider display system of claim 2 further comprising a front barrier designed to deter products from being pushed beyond the front barrier by the spring-urged pusher.

6. The multi-component divider display system of claim 1, wherein the pusher face is extendable in the planar horizontal direction from the first position to one of a plurality of second positions.

7. The multi-component divider display system of claim 6, wherein the pusher face in the first position is located adjacent the divider, and in the one of the plurality of said second positions is located away from the divider.

8. The multi-component divider display system of claim 1, wherein the pusher face is mounted to a pusher base.

9. The multi-component divider display system of claim 8, wherein the pusher base includes at least one flange for mounting the pusher base to the base.

10. The multi-component divider display system of claim 9, wherein the flange of the pusher base is mountable to the at least one pusher track of the base.

11. The multi-component divider display system of claim 9, wherein the pusher base is operatively coupled to a pusher urging element.

12. The multi-component divider display system of claim 1, wherein the base defines a breakaway portion for reducing the length of the base, and wherein the components of the divider define a breakaway portion for reducing the length of the components of the divider.

13. A multi-component divider display system, comprising:

a base for operative coupling to a shelf, the shelf having a front and the base including at least one pusher track;

a divider for dividing displayed merchandise into rows, the divider comprising at least a first divider component and a second divider component, wherein the first divider component extends outwardly from the base and the second divider component is releasably connected to the first divider component; and a spring-urged pusher in the base for pushing merchandise toward the front of the shelf, wherein the pusher is movable in a first direction, the pusher including a pusher face that is linearly slidable in a planar, horizontal direction from a first position to one of a plurality of second positions, wherein the planar, horizontal direction is substantially perpendicular to the first direction.

14. The multi-component divider display system of claim 1, wherein a back side of the pusher face includes a plurality of detents.

15. The multi-component divider display system of claim 14, wherein the pusher face is coupled to the at least one pusher track by a pusher support base.

16. The multi-component divider display system of claim 15, wherein the pusher track is slidably mounted to the pusher support base.

17. The multi-component divider display system of claim 16, wherein a biased extension is mounted to the pusher support base.

18. The multi-component divider display system of claim 17, wherein at least one of the plurality of detents engage the biased extension to hold the pusher face in an the first position or the plurality of second positions.

19. The multi-component divider display system of claim 13, wherein the pusher track and the base and first divider component form a unitary, one-piece construction.

20. The multi-component divider display system of claim 13, wherein the base is operatively coupled to a shelf via a front rail.

21. The multi-component divider display system of claim 13, wherein the pusher face is mounted to a pusher base.

22. The multi-component divider display system of claim 13, wherein the pusher base includes at least one flange for mounting the pusher base to the base.

* * * * *

UNITED STATES PATENT AND TRADEMARK OFFICE

CERTIFICATE OF CORRECTION

PATENT NO. : 8,627,965 B2
APPLICATION NO. : 11/684253
DATED : January 14, 2014
INVENTOR(S) : Stephen N. Hardy It is certified that error appears in the above-identified patent and that said Letters Patent is hereby corrected as shown below:

On the Title Page, Item (63) Related U.S. Application Data, Line 1:
Please replace "Continuation" with --Continuation-in-part--

Signed and Sealed this
Twenty-ninth Day of April, 2014

Michelle K. Lee

Michelle K. Lee
*Deputy Director of the United States Patent and Trademark Office*